US007762647B2

(12) United States Patent
Mehta et al.

(10) Patent No.: US 7,762,647 B2
(45) Date of Patent: Jul. 27, 2010

(54) MEMS PRINTHEAD BASED COMPRESSED FLUID PRINTING SYSTEM

(75) Inventors: Rajesh V. Mehta, Rochester, NY (US); Michael A. Marcus, Honeoye Falls, NY (US); Ruizheng Wang, Rochester, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 454 days.

(21) Appl. No.: 11/860,820

(22) Filed: Sep. 25, 2007

(65) Prior Publication Data

US 2009/0079783 A1 Mar. 26, 2009

(51) Int. Cl.
*B41J 2/015* (2006.01)

(52) U.S. Cl. ..... 347/21; 347/40; 347/47; 347/86

(58) Field of Classification Search ..... 347/20, 347/21, 40, 47, 86
See application file for complete search history.

(56) References Cited

U.S. PATENT DOCUMENTS

| | | | | |
|---|---|---|---|---|
| 4,734,227 | A | 3/1988 | Smith | |
| 4,923,720 | A | 5/1990 | Lee et al. | |
| 6,040,060 | A | 3/2000 | Missel et al. | |
| 6,116,718 | A | 9/2000 | Peeters et al. | |
| 6,129,331 | A | 10/2000 | Henning et al. | |
| 6,338,547 | B1 * | 1/2002 | Silverbrook | 347/54 |
| 6,595,630 | B2 | 7/2003 | Jagannathan et al. | |
| 6,666,548 | B1 | 12/2003 | Sadasivan et al. | |

(Continued)

FOREIGN PATENT DOCUMENTS

| | | |
|---|---|---|
| EP | 1 219 426 A2 | 7/2002 |

(Continued)

OTHER PUBLICATIONS

B. Tan and A. Cooper, "Functional Oligo(Vinyl Acetate)CO2-philes for Solubilization and Emulsification", *J. Am. Chem. Soc.*, 2005, vol. 127, pp. 8938).

(Continued)

*Primary Examiner*—Ellen Kim
(74) *Attorney, Agent, or Firm*—William R. Zimmerli

(57) ABSTRACT

A method and apparatus for delivering a mixture of compressed fluid and marking material and depositing the marking material in a pattern onto a substrate, includes a high pressure source of a mixture of compressed fluid and marking material. A micro-machined manifold includes a plurality of micro-nozzles, a fluid chamber, and an entrance port with portions of a first surface of the micro-machined manifold defining the entrance port with the entrance port being connected in fluid communication with the fluid chamber. Each of the micro-nozzles having an inlet and an outlet with the inlet being connected in fluid communication with the fluid chamber and the outlet being located on the second surface of the micro-machined manifold. Each micro-nozzle is shaped to produce a directed beam of the mixture of compressed fluid and marking material beyond the outlet of the micro-nozzle. A housing is connected in fluid communication with the high pressure source and the entrance port of the micro-machined manifold with the connection being a sealed connection. Optionally, a device operable to capture marking material that does not adhere to the substrate can be included.

25 Claims, 18 Drawing Sheets

U.S. PATENT DOCUMENTS

| | | | | |
|---|---|---|---|---|
| 6,672,702 | B2 * | 1/2004 | Sadasivan et al. | 347/19 |
| 6,752,484 | B2 | 6/2004 | Jagannathan et al. | |
| 6,845,965 | B2 | 1/2005 | Lanting et al. | |
| 6,971,739 | B2 | 12/2005 | Sadasivan et al. | |
| 7,524,046 | B2 * | 4/2009 | Silverbrook et al. | 347/86 |
| 2003/0072716 | A1 | 4/2003 | Poovathinthodiyil et al. | |
| 2005/0158112 | A1 * | 7/2005 | Silverbrook et al. | 400/691 |
| 2006/0041248 | A1 | 2/2006 | Patton et al. | |

FOREIGN PATENT DOCUMENTS

| | | | |
|---|---|---|---|
| EP | 1 369 235 | A2 | 12/2003 |

OTHER PUBLICATIONS

E. Beckmann, "A Challenge for Green Chemistry: Designing Molecules that Readily Dissolve in Carbon Dioxide", *Chem. Commun.* 2004, vol. 17, pp. 1885).

Y. Peles et al., "Fluidic Packaging Of Microengine And Microrocket Devices For High-Pressure And High-Temperature Operation", *J. of Microelectromechanical Systems*, vol. 13, No. 1, pp. 31 (2004).

D. C. Roberts et al., Modeling, Design, and Simulation of a Piezoelectrically Driven Microvalve for High Pressure, High Frequency Applications, *Proceedings of SPIE*, vol. 4327, pp. 366 (2001).

P. Raveendran and S. Wallen, "Sugar Acetates as Novel, Renewable CO2-philes" in *J. Am. Chem. Soc.*, 2002, vol. 124, 7274.

S. Franssila, *Introduction to Micro Fabrication*, John Wiley and Sons, Ltd., 2004.

* cited by examiner

MEMS PRINTHEAD BASED COMPRESSED FLUID PRINTING SYSTEM

FIELD OF THE INVENTION

This invention relates generally to printing and more particularly, to printing mixtures of compressed fluids and marking materials through micro-machined components.

BACKGROUND OF THE INVENTION

Many marking technologies exist for creating marks or patterns on a substrate. The ink jet printing technology commonly known as "drop-on-demand" provides ink droplets (typically including a dye or a mixture of dyes) for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Activation of a pressurization actuator produces an ink jet droplet at orifices of a print head. Typically, one of two types of actuators is used including heat actuators and piezoelectric actuators. With heat actuators, a heater, placed at a convenient location, heats the ink causing a quantity of ink to phase change into a gaseous bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

Conventional ink jet printers are disadvantaged in several ways. For example, in order to achieve very high quality images while maintaining acceptable printing speeds, a large number of discharge devices located on a printhead need to be frequently actuated thereby producing an ink droplet. While the frequency of actuation reduces printhead reliability, it also limits the viscosity range of the ink used in these printers. Typically, adding solvents such as water, etc. lowers the viscosity of the ink. The increased liquid content results in slower ink dry times after the ink has been deposited on the receiver, and this decreases overall productivity. Additionally, increased solvent content can also cause an increase in ink bleeding during drying which reduces image sharpness, negatively affecting image resolution and other image quality metrics. For receivers such as plain paper, excessive liquid can also lead to local mechanical buckling of the receiver.

Conventional ink jet printers are also disadvantaged in that the discharge devices of the printheads can become partially blocked and/or completely blocked with ink. In order to reduce this problem, solvents, such as glycol, glycerol, etc., are added to the ink formulation, which can adversely affect image quality. Alternatively, discharge devices are cleaned at regular intervals in order to reduce this problem. This increases the complexity of the printer.

Other technologies that deposit a dye onto a receiver using gaseous propellants are known. For example, E. Peeters et al., in U.S. Pat. No. 6,116,718, issued Sep. 12, 2000, disclose a print head for use in a marking apparatus in which a propellant gas is passed through a channel, the marking material is introduced controllably into the propellant stream to form a ballistic aerosol for propelling non-colloidal, solid or semi-solid particulate or a liquid, toward a receiver with sufficient kinetic energy to fuse the marking material to the receiver. A disadvantage of this technology is that the marking material and propellant stream are two different entities. When the marking material is added into the propellant stream in the channel, a non-colloidal ballistic aerosol is formed prior to exiting the print head. This non-colloidal ballistic aerosol, which is a combination of the marking material and the propellant, is thermodynamically not stable. As such, the marking material is prone to settling in the propellant stream which, in turn, can cause marking material agglomeration, leading to nozzle obstruction and poor control over marking material deposition.

Technologies that use supercritical fluid solvents to create thin films are also known. For example, R. D. Smith in U.S. Pat. No. 4,734,227, issued Mar. 29, 1988, discloses a method of depositing solid films or creating fine powders through the dissolution of a solid material into a supercritical fluid solution and then rapidly expanding the solution to create particles of the marking material in the form of fine powders or long thin fibers, which may be used to make films. C. Lee et al. in U.S. Pat. No. 4,923,720, issued May 8, 1990, disclose a liquid coating process and apparatus in which supercritical fluids, such as supercritical carbon dioxide, are used to reduce to application consistency viscous coating compositions to allow for their application as liquid sprays. In these disclosures the free-jet expansion of the supercritical fluid solution results in sprays with a shape that cannot be used to create high-resolution patterns on a receiver without a mask.

U.S. Pat. No. 6,752,484 entitled "Apparatus And Method of Delivering A Beam of A Functional Material To A Receiver" by R. Jagannathan et al. discloses a method and apparatus for delivering a solvent free marking material to a receiver wherein the discharge device is shaped to produce a collimated beam of the marking material with the fluid being in a gaseous state at a location beyond the outlet of the discharge device. Thus, this method describes delivering of marking materials in a manner such that it solves many of the drying related problems inherent to conventional, solvent based systems.

U.S. Pat. No. 6,971,739 entitled "Method And Apparatus For Printing" issued Dec. 6, 2005 by S. Sadasivan et al. describes a printhead for delivering marking material to a receiver includes a discharge device having an inlet and an outlet with a portion of the discharge device defining a delivery path. An actuating mechanism is moveably positioned along the delivery path. A material selection device has an inlet and an outlet with the outlet of the material selection device being connected in fluid communication to the inlet of the discharge device. The inlet of the material selection device is adapted to be connected to a pressurized source of a thermodynamically stable mixture of a fluid and a marking material, wherein the fluid is in a gaseous state at a location beyond the outlet of the discharge device.

U.S. Pat. No. 6,672,702 by S. Sadasivan et al. entitled "Method and Apparatus for Printing, Cleaning and Calibrating" describes a printing apparatus comprising: a pressurized source of a thermodynamically stable mixture of a compressed fluid and a marking material; a pressurized source of a compressed fluid; a material selection device having a plurality of inlets and an outlet, one of the plurality of inlets being connected in fluid communication to the pressurized source of compressed fluid and another of the plurality of inlets being connected in fluid communication to the thermodynamically stable mixture of the compressed fluid and the marking material; a printhead, portions of the printhead defining a delivery path having an inlet and an outlet, the inlet of the delivery path being connected in fluid communication to the outlet of the material selection device; and an actuating mechanism moveably positioned along the delivery path, wherein, the compressed fluid is in a gaseous state at a location beyond the outlet of the delivery path; and a cleaning station positioned relative to the printhead, wherein the printhead is moveable to a position over the cleaning station. This patent also includes a marking material measuring device useful for calibrating the amount of marking material being delivered to the substrate.

U.S. Pat. No. 6,595,630 by R. Jagannathan et al. entitled "Method And Apparatus For Controlling Depth of Deposition of a Solvent Free Functional Material In A Receiver" describes a method of delivering a functional material to a receiver comprising in order: providing a mixture of a fluid having a solvent and a functional material; causing the functional material to become free of the solvent; causing the functional material to contact a receiver having a plurality of layers and causing the functional material to penetrate and pass through the first layer of the receiver and penetrate a second layer of the receiver such that the second layer primarily contains the functional material.

For broad use applications, there is still a need to employ discharge devices that enable efficient mass manufacturing of printing systems that use compressed fluids based marking materials. Micro-machined devices are advantageous from that perspective although with shrinking dimensions come many challenges of material properties, ability to design and fabricate micro-machined structures to perform under high pressures, and operating without clogging of micro-nozzles. Micro Electro Mechanical Systems (MEMS) are used in many mass-market commercial devices such as accelerometers, pressure sensors, ink jet printer heads, and digital mirror arrays for projectors.

The ability to develop viable MEMS in any new area is to a large degree enabled and constrained by the set of materials and micro-machining processes from which a designer can select. Hitherto the vast majority of commercial MEMS have utilized the Complementary Metal Oxide Semiconductor (CMOS) and Very Large Scale Integration (VLSI) materials and process set. Details of such materials and processes are available in published literature including, for example, *Introduction to Micro Fabrication* by Sami Franssila, 2004, John Wiley and Sons, Ltd. So far, viable MEMS for printing with compressed fluids have not been disclosed. For such a system, in addition to known problems of nozzle shape, control valves, and their effect on jet collimation, a number of other problems need to be solved. For example, it is not obvious whether CMOS/VLSI materials can withstand the high pressures required for use in a compressed fluid printing process and that they can be useful for making micro-machined nozzles. Also, it is not obvious which materials and methods may provide a leak-proof connection from the high-pressure source of the marking material to the micro-machined nozzles. Methods that work at macro-scale do not necessarily work at micro-scale because uniformity of material properties and distribution of mechanical forces during assembly become more exacting.

Another problem with printing using compressed fluid formulations is that some portion of the jetted marking material that is in the form of nanometer size particles, not Pico-liter sized droplets, may escape along with the effluent gas into the nearby environment and create a potential health hazard. The printing system should be designed to minimize or eliminate such exposure to operators. The collection of such materials is fundamentally different from other continuous ink jet systems where the Pico-liter sized droplets are collected in a gutter when they are not intended to go to the substrate for printing.

Furthermore, many marking materials have a limited solubility in the pure compressed fluids and that limits the scope of this technology. Using conventional solvents as co-solvents with compressed fluids can enhance the solubility. While spray coating technologies for conventional solvent containing compressed fluids are known, directed beam printing with such fluids is not reported.

SUMMARY OF THE INVENTION

In accordance with one embodiment of the present invention, a printing apparatus is disclosed for delivering a mixture of compressed fluid and marking material and depositing the marking material in a pattern onto a substrate. The apparatus includes a high pressure source of a mixture of compressed fluid and marking material. A micro-machined manifold includes a plurality of micro-nozzles, a fluid chamber, an entrance port, and a first surface and a second surface. Portions of the first surface define the entrance port, the entrance port being connected in fluid communication with the fluid chamber. Each of the micro-nozzles have an inlet and an outlet, the inlet being connected in fluid communication with the fluid chamber, the outlet being located on the second surface. Each micro-nozzle is shaped to produce a directed beam of the mixture of compressed fluid and marking material beyond the outlet of the micro-nozzle. A housing is connected in fluid communication with the high pressure source and the entrance port of the micro-machined manifold, the connection between the housing and the micro-machined manifold being a sealed connection.

In accordance with another embodiment of the present invention the printing apparatus further comprises a device operable to capture marking material that does not adhere to the substrate.

In accordance with yet another embodiment of the present invention, a method of printing is disclosed. The method comprises providing a high pressure source of a mixture of compressed fluid and marking material; providing a micro-machined manifold including a first surface and a second surface, portions of the first surface defining an entrance port, the entrance port being connected in fluid communication with a fluid chamber, a plurality of micro-nozzles each having an inlet and an outlet, the inlet being connected in fluid communication with the fluid chamber, the outlet being located on the second surface, each micro-nozzle being shaped to produce a directed beam of the mixture of compressed fluid and marking material beyond the outlet of the micro-nozzle; providing a housing connected in fluid communication with the high pressure source and the entrance port of the micro-machined manifold; and controlling the pressure of the mixture of compressed fluid and marking material to create a directed beam of the mixture of compressed fluid and marking material beyond each outlet of each micro-nozzle.

An advantage of the present invention is that CMOS/VLSI materials and processes can be used to make micro-machined manifolds for printing with compressed fluids. This enables low-cost mass production of micro-machined manifolds. Another advantage is the simple sealing methods like clamped gaskets can be used to provide leak-proof connection between the micro-machined manifold and the high-pressure source. Another advantage of the present invention is that marking material and effluent gases that escape during printing can be collected to provide a safer operation. A further advantage is that a wide variety of materials including those using conventional solvents as co-solvents can be directly printed with the apparatus disclosed in this invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. Additionally, materials identified as suitable for various facets of the invention, for example, marking materials, solvents, equipment, etc. are to be treated as exemplary, and are not intended to limit the scope of the invention in any manner.

Figure 1:
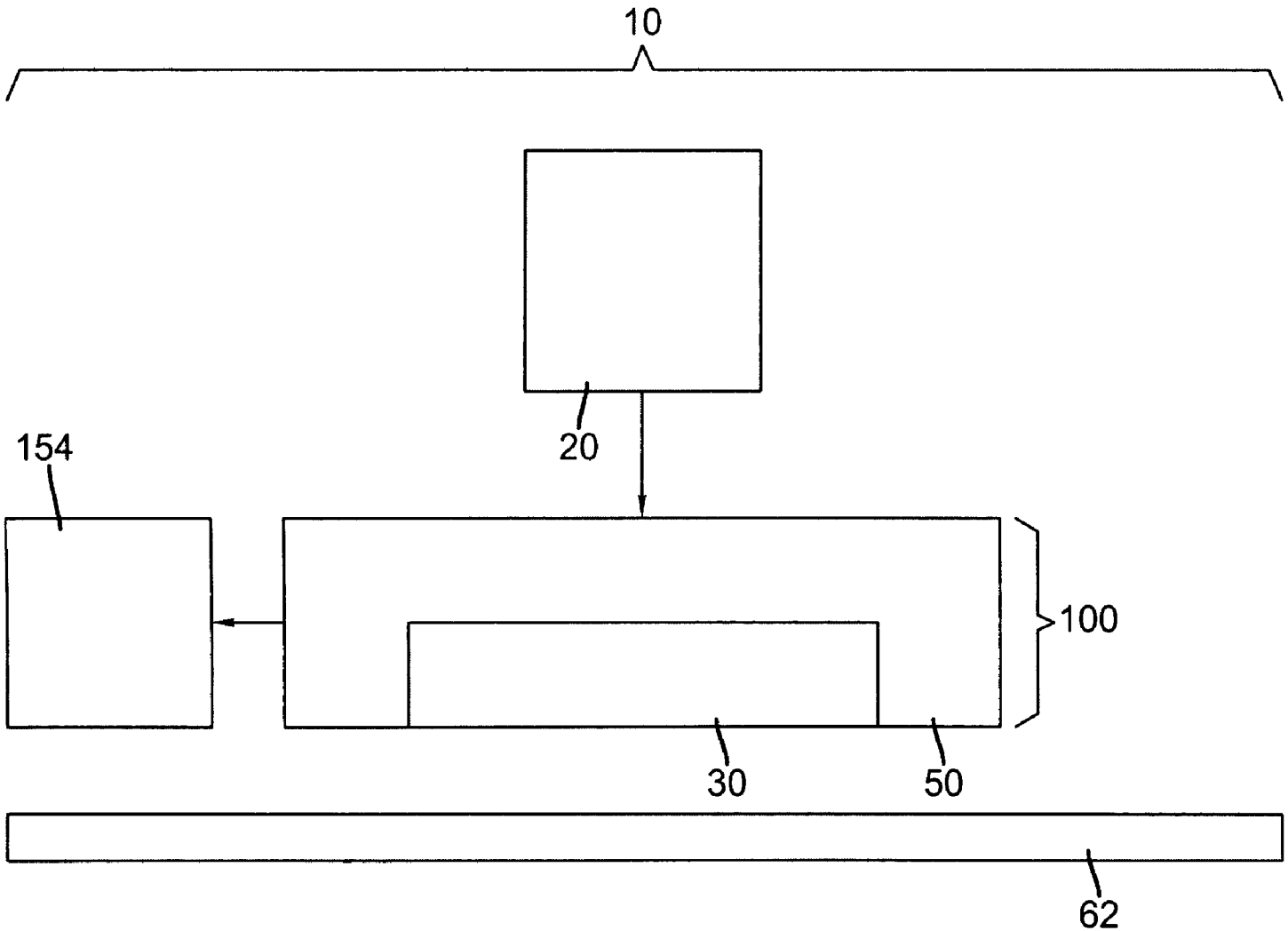
FIG. 1 is a general schematic view of a printing apparatus made in accordance with the present invention.

FIG. 1 shows a general schematic view of a printing apparatus 10 for delivering a mixture of compressed fluid and marking material and depositing the marking material in a pattern on to a substrate. The apparatus comprises a high-pressure source 20 containing the mixture of compressed fluid and marking material coupled to a printhead 100 including a micro-machined manifold 30 and a housing 50, an optional collection means 154, and a substrate conveyance mechanism 62. The substrate fits into the substrate conveyance mechanism so that it faces the printhead 100. The apparatus may also include a printhead conveyance mechanism (not shown). By having both a substrate conveyance mechanism 62 and a printhead conveyance mechanism relative motion between the printhead 100 and the substrate can be controlled to deposit marking material in a pattern onto the substrate. The high pressure source 20 is utilized to dissolve and/or disperse marking materials in a compressed fluid mixture with or without dispersants and/or surfactants, at desired conditions of temperature, pressure, volume, and concentration. The micro-machined manifold 30 has a sealed connection to the housing 50 and includes the micro-nozzles or discharge device which allows jetting of the mixture of compressed fluid and marking material onto a substrate held by the substrate conveyance mechanism 62. The collection means 154 is used to collect material that is not deposited on the substrate.

The high-pressure source 20 can be made out of any suitable materials that can safely operate at the formulation conditions. Desirable high pressure source materials should withstand an operating pressure range from 0.001 atmospheres ($1.013\times10^2$ Pa) to 1000 atmospheres ($1.013\times10^8$ Pa) in pressure and a temperature range from −25 degrees Centigrade to 1000 degrees Centigrade. Typically, the preferred materials include various grades of high-pressure stainless steel. However, it is possible to use other materials if the specific deposition or etching application dictates less extreme conditions of temperature and/or pressure. The high-pressure source 20 should also be precisely controlled with respect to the operating conditions (pressure, temperature, and volume). The solubility/dispersibility of marking materials depends upon the conditions within the high-pressure source 20. As such, small changes in the operating conditions within the high-pressure source 20 can have undesired effects on marking material solubility/dispensability.

Materials that are above their critical point, defined by a critical temperature and a critical pressure, are known as supercritical fluids. The critical temperature and critical pressure typically define a thermodynamic state in which a fluid or a material becomes supercritical and exhibits gas like and liquid like properties. Materials that are at sufficiently high temperatures and pressures below their critical point are known as compressed liquids. The fluid contained in the high-pressure source 20 may include a compressed liquid having a density equal to greater than 0.1 g per cubic centimeter; or a supercritical fluid having density equal to or greater than 0.1 g per cubic centimeter; or a compressed gas having a density equal to or greater than 0.1 g per cubic centimeter or any combination thereof. The fluid contained in the high-pressure source 20 may also include any solvent or mixture of solvents that are miscible with the supercritical fluids and/or compressed liquids. Ambient conditions are preferably defined as temperature in the range from −100 to +100° C., and pressure in the range from $1\times10^{-3}$-100 atmosphere for this application. Materials in their supercritical fluid and/or compressed liquid state that exist as gases at ambient conditions find application here because of their unique ability to solubilize and/or disperse functional materials of interest in the compressed liquid or supercritical state. In the context of this invention, the compressed fluid mixture contained in the high-pressure source 20 includes any fluid that dissolves/solubilizes/disperses a marking material where at least one fluid is gas at ambient pressure and temperature. In many cases, the compressed fluid mixture may also include conventional organic solvents as co-solvents. The combination of marking material and compressed fluid is typically referred to as a mixture, formulation, composition etc. The mixture or formulation of marking material and compressed fluid is called thermodynamically stable when the marking material is dissolved or dispersed within the compressed fluid in such a fashion as to be indefinitely contained in the same state as long as the temperature and pressure within the high-pressure source are maintained constant. This state is distinguished from other physical mixtures in that there is no settling, precipitation, and/or agglomeration of marking material particles within the high-pressure source unless the thermodynamic conditions of temperature and pressure within it are changed.

Compressed fluids include but are not limited to: carbon dioxide, nitrous oxide, ammonia, xenon, ethane, ethylene, propane, propylene, butane, isobutane, chlorotrifluoromethane, monofluoromethane, sulfur hexafluoride and mixtures thereof. Carbon dioxide is generally preferred as the compressed fluid of choice in many applications due to its low cost, wide availability, and usable temperature and pressure ranges.

Suitable conventional solvents include but are not limited to: ketones such as acetone, methyl ethyl ketone, methyl isobutyl ketone, methyl amyl ketone, cyclohexanone and other aliphatic ketones; esters such as methyl acetate, ethyl acetate, alkyl carboxylic esters, methyl t-butyl ethers, dibutyl ether, methyl phenyl ether, other aliphatic or alkyl aromatic ethers; glycol ethers such ethoxyethanol, butoxyethanol, ethoxypropanol, propoxyethanol, butoxypropanol, and other glycol ethers; glycol ether esters such as butoxyethoxy acetate, ethyl ethoxy propionate and other glycol ether esters; alcohols such as methanol, ethanol, propanol 2-propanol, butanol, amyl alcohol and other aliphatic alcohols; aromatic hydrocarbons such as toluene, xylene, and other aromatics or mixtures of aromatic solvents; and nitro alkanes such as 2-nitropropane. Generally the solvents suitable for this invention must have the aforementioned miscibility and must also be able to wet or be a good solvent for the marking material. Typically the ratio of solvent to marking material is from about 0.01:1 to about 100:1 where as typically the ratio of compressed fluid to marking material is from about $1\times10^5$:1 to about 4:1.

The marking material may be a solid or a liquid, but it is preferred that it is solid. Additionally, the marking material can be an organic molecule, a polymer molecule, a metallo-organic molecule, an inorganic molecule, an organic nanoparticle, a polymer nanoparticle, a metallo-organic nanoparticle, an inorganic nanoparticle, an organic microparticles, a polymer micro-particle, a metallo-organic microparticle, an inorganic microparticle, and/or composites of these materials, etc. Suitable polymers include vinyl, acrylic, styrenic and interpolymers of the base vinyl, acrylic and styrenic monomers; polyesters, alkyds, polyurethanes, cellulosic esters, amino resins, natural gums and resins, and cross-linkable film forming agents. Additionally, any suitable surfactant and/or dispersant material that is capable of solubilizing/dispersing the marking materials in the compressed fluid mixture for a specific application can be incorporated into the combination of marking material and compressed fluid mixture. Such materials include, but are not limited to, cyclodextrins, fluorinated polymers such as perfluoropolyether, siloxane compounds, etc. However, such polymeric materials often cause printing nozzle clogging. Therefore, it is also advantageous to use marking materials that have higher solubility in CO2. Such materials obviate the need for polymeric surfactants for solubilization. A general design principle for CO2-compatible materials is to tether the desired substances to one or more solubilizers with a very high affinity for CO2 (See paper by E. Beckmann entitled "A Challenge for Green Chemistry: Designing Molecules that Readily Dissolve in Carbon Dioxide" published in *Chem. Commun.* 2004, Vol. 17, pp. 1885). P. Raveendran and S. Wallen disclose in U.S. Patent Application No. 20030072716 entitled "Renewable, carbohydrate based $CO_2$-philes" a composition comprising a carbohydrate-based material dispersed in carbon dioxide. The carbohydrate-based material comprises a carbohydrate and at least one non-fluorous $CO_2$-philic group. Carbon dioxide can be supercritical, liquid or gaseous. The carbohydrate can be a monosaccharide, a disaccharide, a trisaccharide, a polysaccharide, a cyclic saccharide or an acyclic saccharide. The $CO_2$-philic group is selected from the group consisting of an acetyl group, a phosphonyl group, a sulfonyl group, —O—C(O)—$R_n$, —C(O)—$R_n$, —O—P(O)—(O—$R_n$)2, and —$NR_nR_{n'}$ where $R_n$ and $R_{n'}$ are independently hydrogen or an alkyl group. They also disclose a method of forming a composition comprising a carbohydrate-based material dispersed in carbon dioxide. In a preferred embodiment, the method comprises: (a) providing a $CO_2$-phobic carbohydrate comprising one of one or more hydroxyl groups and one or more or ring hydrogens; (b) chemically replacing at least one of a hydroxyl group and a ring hydrogen with a non-fluorous $CO_2$-philic group to form a carbohydrate-based material; and (c) dispersing the carbohydrate-based material in carbon dioxide, whereby a composition comprising a carbohydrate-based material dispersed in carbon dioxide is formed. Similarly, an example of $CO_2$-phobic dyestuff tethered to $CO_2$-phillic vinyl acetate oligomer was reported in a paper by B. Tan and A. Cooper entitled "Functional Oligo (Vinyl Acetate) $CO_2$-philes for Solubilization and Emulsification" in *J. Am. Chem. Soc.,* 2005, Vol. 127, pp. 8938). In general, the '$CO_2$-phobic' part can be a functional unit such as a dyestuff, a polymer, a reagent or a catalyst, or it might be designed to interact with other $CO_2$-insoluble molecules, giving the whole ensemble the function of a surfactant. All such variations in marking material are contemplated for use with the present invention.

Figure 2:
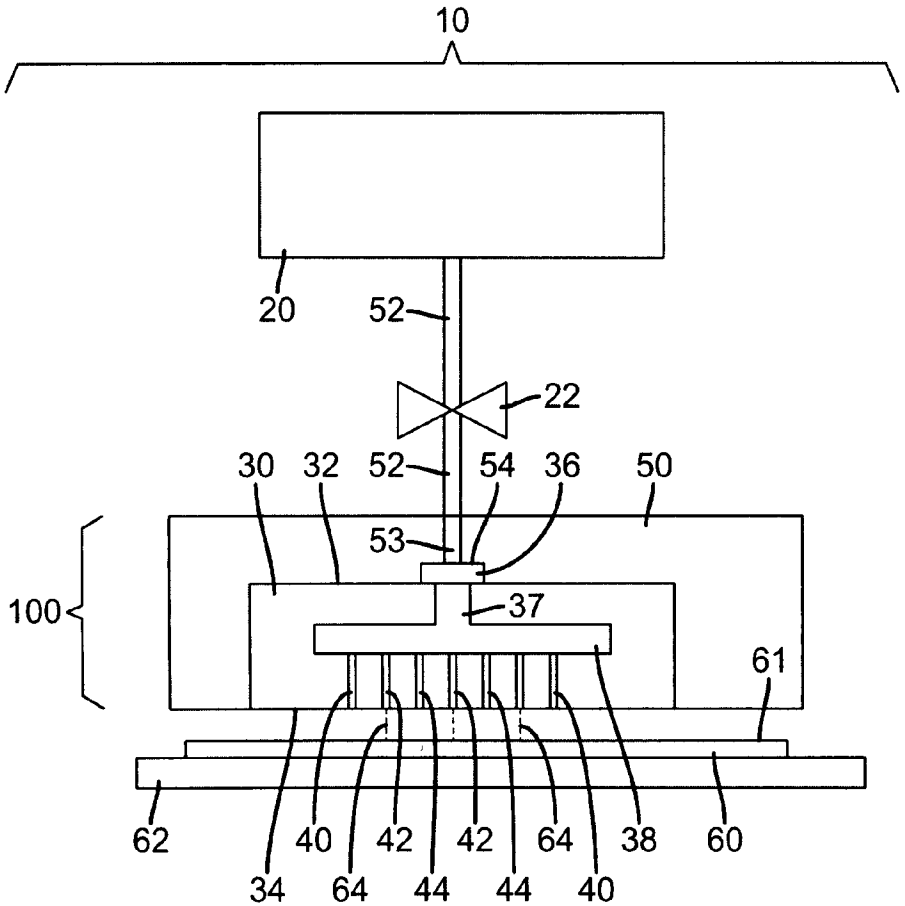
FIG. 2 is a schematic view of a first embodiment of a printing apparatus made in accordance with the present invention.

FIG. 2 shows a detailed schematic of a first embodiment of a printing apparatus 10 useful for carrying out the present invention. The micro-machined manifold 30 has a first surface 32 and a second surface 34, an entrance port 36 on the first surface which is defined as the entrance to a through hole 37 that enters a fluid chamber 38 interposed between said first and second surfaces, and a plurality of micro nozzles 40, each having an inlet 42 to permit fluid communication with the fluid chamber 38 and an outlet 44 on the second surface 34. In all of the Figures open-ended arrows are used to denote surfaces or features that occur only at surfaces whereas other parts are labeled with filled arrows. The housing 50 surrounds the micro-machined manifold 30 to provide mechanical support and interfacing capability to external positioning equipment as required by the particular printing application. The housing includes a housing conduit 53 coupled to the entrance port 36 of the micro-machined manifold 30 through an optional sealing member 54. The housing conduit 53 is coupled to a conduit 52 that connects the high-pressure source 20 to the housing 50 and permits fluid communication between the high-pressure source 20 and the entrance port of the micro-machined manifold 30. The conduit 52 also includes an on/off valve 22 positioned between the high-pressure source 20 and the entrance port 36 of the micro-machined manifold 30 for turning on and off the flow of the mixture of compressed fluid and marking material from the high-pressure source 20 in to the micro-machined manifold 30. The optional sealing member 54 can be interposed between the first surface of the micro-machined manifold 30 and the housing 50 to seal the entrance port 36 of the micro-machined manifold 30 so that the mixture of compressed fluid and marking material can be sent through the each of the micro-nozzles 40 without leaking. A sealed connection can also be made with proper clamping in conjunction with mating of specially machined surfaces on the housing 50. It can also be made by use of a sealing member 54. Suitable sealing members 54 include gaskets made from pure metal or metal alloy foils, Teflon, and other polymeric materials. In addition to well known clamping and glue-bonding, sealing can also be provided through bonding procedures, for example, as described by Y. Peles et al. in a paper entitled "Fluidic Packaging Of Microengine And Microrocket Devices For High-Pressure And High-Temperature Operation" published in *J. of Microelectromechanical Systems*, Vol. 13, No. 1, pp-31 (2004). It is often advantageous to seal across the entire surface of the micro-machined manifold instead of specific connections at the entrance ports of the micro-machined manifold, by interposing a sealing member between the first surface of the micro-machined manifold and the housing. The term "sealed connection" means a leak-tight connection made with or without a separate sealing member.

During operation of printing apparatus 10 a substrate 60, which may be supported by a substrate conveyance mechanism 62, is spaced relative to the outlets of the micro nozzles 40. The substrate conveyance mechanism 62 can be utilized to maintain the substrate 60 at a defined distance from the outlets of the micro nozzles 40 and for interfacing with external positioning equipment as required by the particular application.

When operating printing apparatus 10, the high-pressure source 20 of the mixture of compressed fluid and marking material are maintained at a desirable temperature and pressure. The conduit 52 and housing 50 are also maintained at a desired temperature usually within ±50° C. of the temperature inside the high-pressure source. When on/off valve 22 is opened the mixture of compressed fluid and marking material is delivered in to the fluid chamber 38 of the micro-machined manifold 30 and exits through the outlets 44 of the micro-nozzles 40 as directed beams 64 of the mixture of compressed fluid and marking material. A directed beam keeps the marking material along a narrow path in space. The divergence angle of the directed beam is the angle made by the boundary of the directed beam with the line perpendicular to the second surface 34 at the outer edge of the micro-nozzle. A pattern is a set of markings having defined spatial characteristics (for example, lines, letters, shapes etc.). The directed beams 64 are projected on to the substrate 60 thereby depositing the marking material in a pattern on the substrate 60. The divergence angle can be calculated from knowing the distance from the second surface 34 at the micro-nozzle outlet 44 to the facing surface of the substrate 61 and by measuring the dimensions of the printed features on the substrate 60. It is preferred that the divergence angle of the directed beam is less than 10 degrees, more preferably less than 5 degrees, and most preferably less than 3 degrees.

Figure 3:
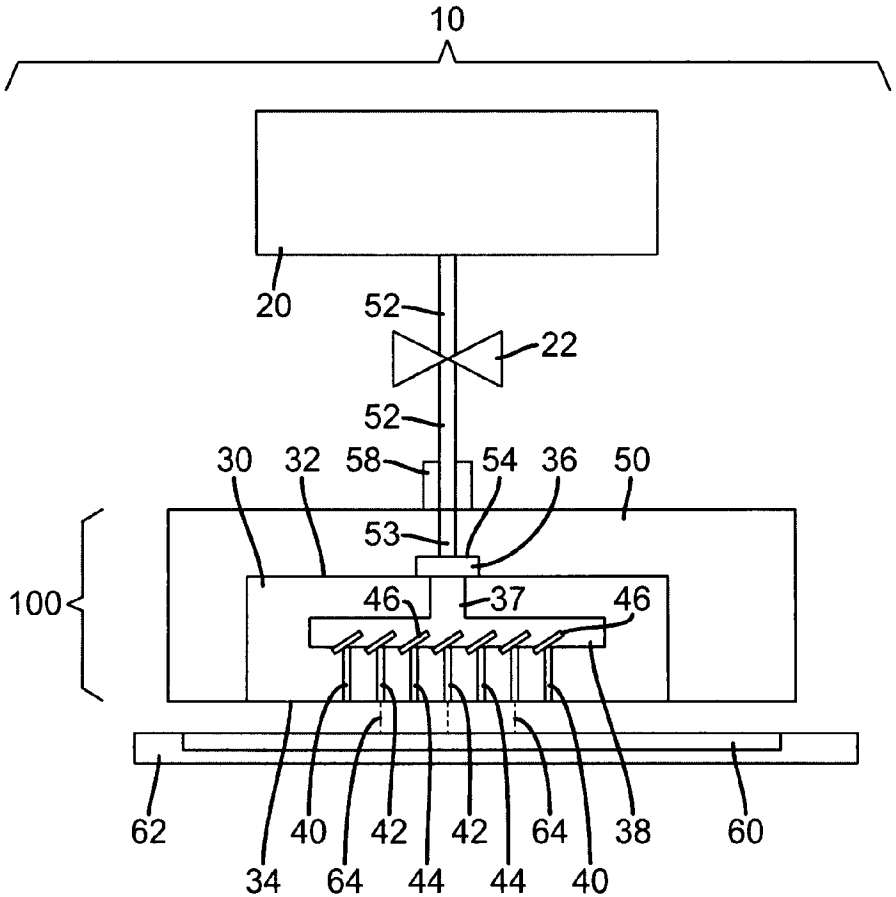
FIG. 3 is a schematic view of a second embodiment of a printing apparatus made in accordance with the present invention.

FIG. 3 shows second embodiment of a printing apparatus for delivering a mixture of compressed fluid and marking material and depositing the marking material in a pattern on to a substrate. This embodiment shows an optional conduit connection means 58 used to connect the housing conduit 53 to the conduit 52. This embodiment also includes control valves 46 positioned along each of said plurality of micro-nozzles. Each control valve, 46, has a first position that provides a continuous delivery path and a second position that restricts the flow of said compressed fluid mixture through each of said micro-nozzles. Each control valve is individually controlled, and it may include piezoelectric, thermal, electromagnetic and or electrostatic actuation mechanisms. These control valves are used to control the flow of marking material to the substrate and will typically turn on and off in time scales of 0.00001 to 1 sec. Relevant control valve structures can be incorporated based on published literature. For example, D. C. Roberts et al. disclose a piezoelectrically driven micro-valve for high pressure, high-frequency applications in *Proceedings of SPIE*, Vol. 4327, pp-366 (2001). Other examples include the micro-valve disclosed by Henning et al in U.S. Pat. No. 6,129,331 entitled "Low power thermopneumatic micro-valve" and a micro-valve actuator disclosed by R. J. Barron et al. in U.S. Pat. No. 6,845,962 issued Jan. 25, 2005 entitled "Thermally Actuated Microvalve Device".

Figure 4:
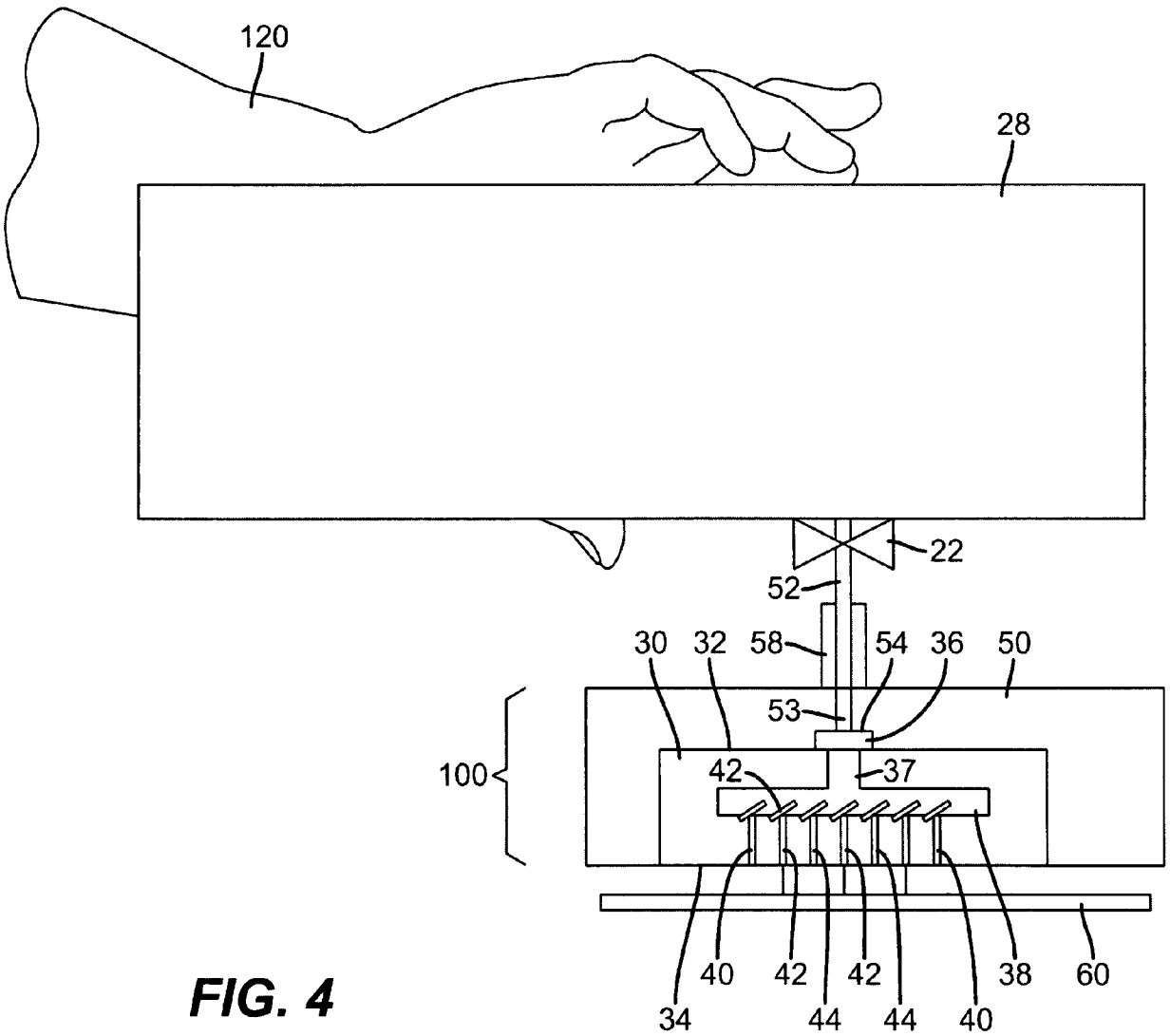
FIG. 4 is a schematic view of an embodiment of a portable printing apparatus made in accordance with the present invention.

FIG. 4 shows an embodiment of a portable printing apparatus 10 for delivering a mixture of compressed fluid and marking material and depositing the marketing material in a pattern on the substrate. In this embodiment, the high-pressure source 20 is replaced by a removable canister 28 preloaded with a predetermined amount of a mixture of marking material and a compressed fluid in a thermodynamically stable mixture. The on/off valve 22, and the conduit 52 are attached to the removable canister 28. The conduit 52 is connected to the housing 50 through the conduit connection means 58. The conduit connection means 58 may be any type of leaked type connector, such as a Swagelock, NPT or high-pressure pipe fitting and provides for rapid connection and removal of the removable canister 28 from the printhead 100. The housing 50 has the appropriate mating connection attached above the sealing member 54 in order to successfully connect the removable canister 28 to the rest of the printing apparatus 10. The removable canister 28 is thus removably connected to the housing 50 via the conduit connection means 58. This printing apparatus can be made portable and the removable canister 28 can be made so that an operator 120 can easily grip it in his or her hands. The entire printing apparatus can thus be handheld and it is possible to print patterns on any surface under operator control. The on/off valve 22 may also be operated by a push button so that the operator 120 can readily control the flow of compressed fluid and marking material onto a substrate 60.

Figure 5:
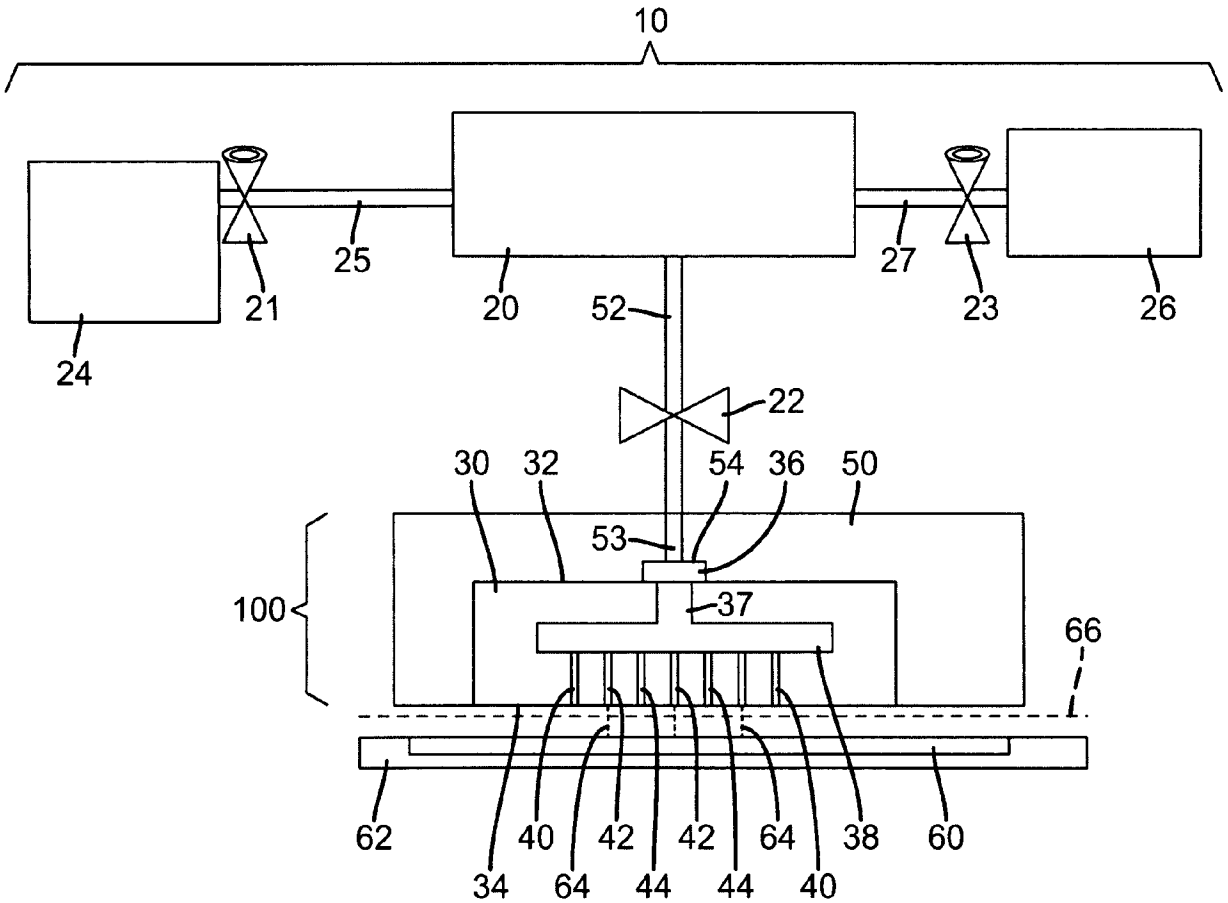
FIG. 5 is a schematic view of a fourth embodiment of a printing apparatus made in accordance with the present invention.

FIG. 5 shows a fourth embodiment of a printing apparatus 10 for delivering a mixture of compressed fluid and marking material and depositing the marketing material in a pattern on the substrate. In this embodiment, a separate source of compressed fluid 24 is connected to the high-pressure source 20 containing the mixture of compressed fluid and marking material via compressed fluid conduit 25. A compressed fluid control valve 21 is in the compressed fluid conduit 25 to control the flow of compressed fluid into the high-pressure source 20. A separate source of marking material 26 is also connected to the high-pressure source 20 containing the mixture of compressed fluid and marking material via marking material conduit 27. A marking material control valve 23 is in the marking material conduit 25 to control the flow of marking material into the high-pressure source 20. This enables separate control of input of marking material, and compressed fluid to the high-pressure source 20 thus enabling sustained continuous operation. An optional shutter 66 can be included between the micro-nozzle outlets 44 and the substrate 60. The shutter also enables control of the delivery time of the mixture of compressed fluid and marking material exiting the micro-nozzles 40 onto the substrate 60. When the shutter is open the directed beams 64 of the mixture of compressed fluid and marking material will hit the substrate 60, and when it is closed they will not. The shutter may also include a shutter collection means (not shown) to collect the jetted material exiting from the micro-nozzles 40 when the shutter is closed.

The printing apparatus 10, shown in FIGS. 1-5, may also include multiple high-pressure sources 20 containing different mixtures of compressed fluid and marking materials coupled to the micro-machined manifold 30 containing multiple entrance ports 36 for each of the high pressure sources 20. Each of the high pressure sources 20 will also have their own temperature and pressure control means. Each of the multiple entrance ports 36 will be connected to their own separate fluid chamber 38 with their own micro-nozzle arrays 40. Multiple fluid chamber 38 containing manifolds are useful in applications requiring printing of multiple marking materials on to a substrate such as color printing. Also, any of the printing apparatus shown in FIGS. 1-5 may include a shutter 66.

Figure 6:
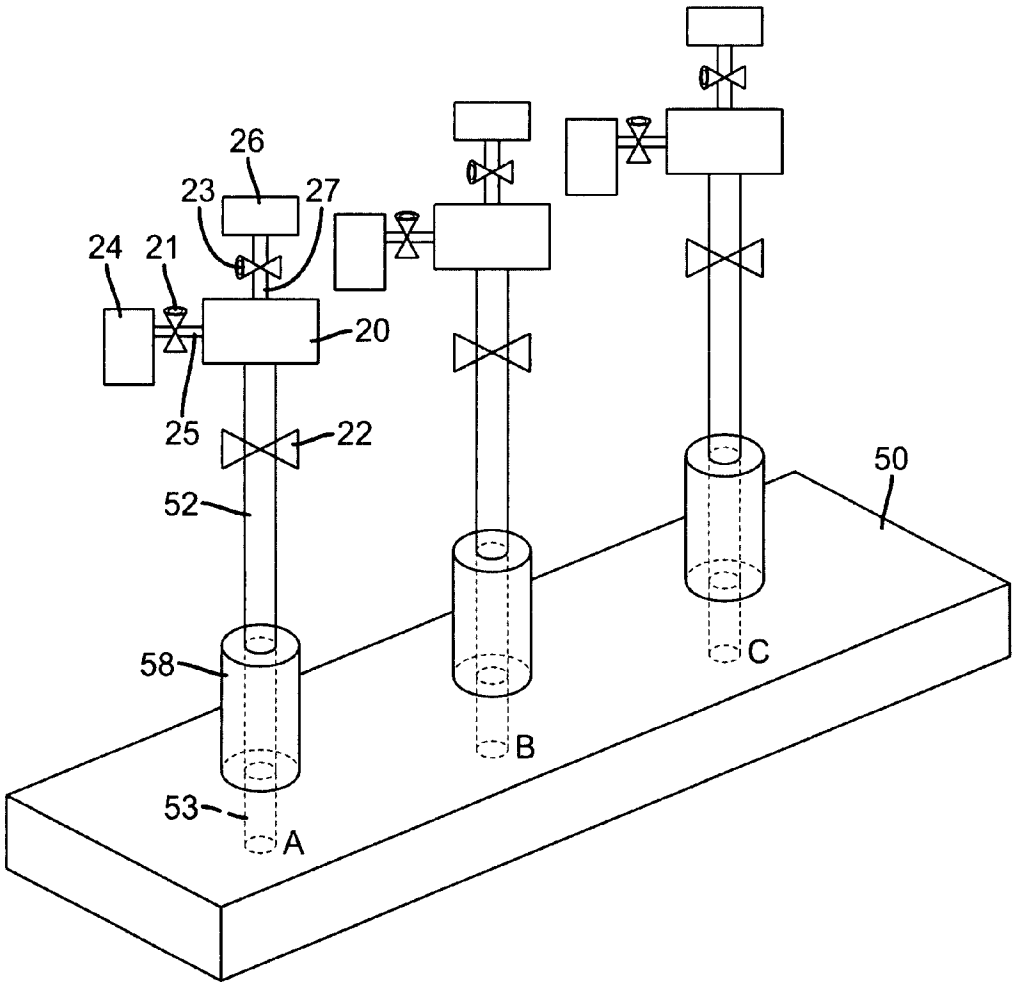
FIG. 6 is a partial view of a multiple source printing apparatus made in accordance with the present invention.

FIG. 6 shows a partial view of a printing apparatus 100 with multiple high-pressure sources 20A, 20B and 20C made in accordance with the present invention. Shown in FIG. 6 is the top of the housing 50 and the external connections to the multiple high-pressure sources 20A, 20B and 20C containing separate sources of compressed fluid 24A, 24B and 24C and marking material 26A, 26B and 26C. The conduit connection means 58A, 58B and 58C connect the external conduits 52A, 52B and 52C to the housing conduits 53A, 53B and 53C. Compressed fluid control valves 21A, 21B and 21C control the flow of compressed fluid from the sources of compressed fluid 24A, 24B and 24C into the high-pressure sources 20A, 20B and 20C. Similarly, the marking material control valves 23A, 23B and 23C control the delivery of marking material from the sources of marking material 26A, 26B and 26C into the high-pressure sources 20A, 20B and 20C. Thus it is possible to control the delivery of multiple mixtures of compressed fluid and marking materials independently into a micro-machined manifold.

Figure 7:
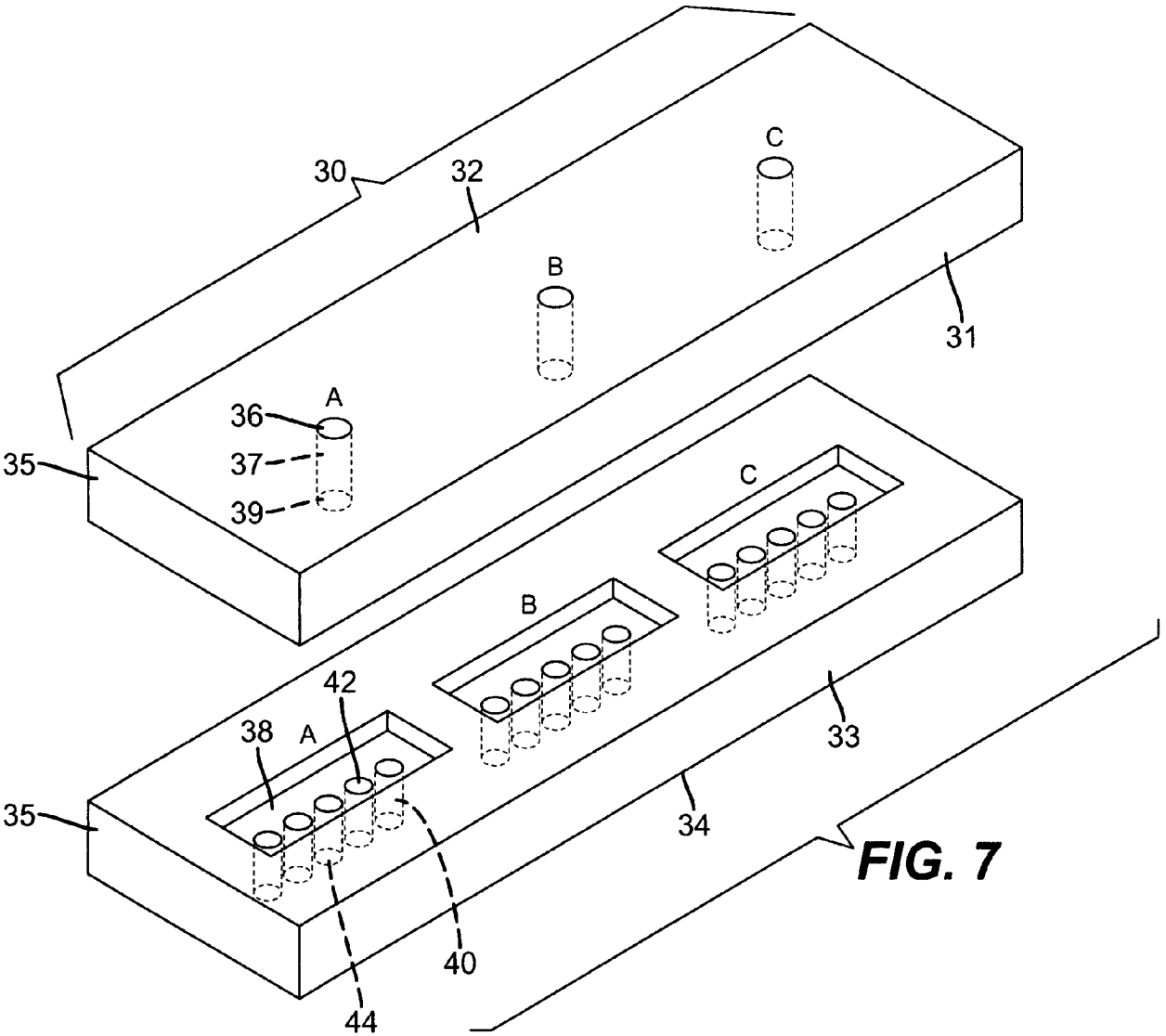
FIG. 7 is an exploded view of a micro-machined manifold used to carry out the present invention.

FIG. 7 shows an exploded view of a micro-machined manifold 30 containing multiple entrance ports 36 each with their own fluid chamber 38 labeled A, B and C and each containing micro-nozzle arrays 40. This configuration of manifold has the first surface 32 parallel to the second surface 34. The micro-machined manifold 30 is assembled from two separate parts. The first piece of the manifold 31 includes the first surface of the manifold 32 which fit into housing 50 and sealed to the conduit 52 by the sealing member 54. The first piece of the manifold 31 is a diced wafer with micro-machined through holes 37 with entrance ports 36, and fluid chamber inlets 39. The second piece of the manifold 33 includes multiple micro machined fluid chambers 38 and micro-nozzle 40 arrays each having a micro-nozzle inlet 42 at the floor of the micro machined fluid chambers 38 and micro-nozzle outlets 44 on the second surface 34 of the micro-machined manifold 30. The two parts are prepared separately, and are made preferably out of silicon, glass or other micro-machinable substrates in the form of flat wafers.

Details of micro machining processes can be found in any standard textbook on Micro fabrication such as *Introduction to Micro Fabrication* by Sami Franssila, 2004, John Wiley and Sons, Ltd. The micro-machined manifold 30 can be made prepared from single crystalline, polycrsystalline or amorphous silicon wafers or from other materials including quartz ($SiO_2$), gallium arsenide (GaAs), silicon carbide (SiC), fused silica, sapphire, alumina, other glasses, polymers or stainless steel. Usually the micro-machined manifold 30 would be manufactured in the following sequence. Typically the fluid chambers 38 would be prepared first by a deep reactive ion etch (DRIE) process. The through holes would then be etched. After micro machining the two parts are cleaned, aligned and then bonded together at the bond surfaces 35. Bonding may be performed by any direct or indirect bonding technique with deposited layers. Suitable bonding techniques include fusion bonding, anodic bonding, thermo-compression bonding or adhesive bonding. After bonding the wafers together they are diced to final dimensions.

Figure 8:
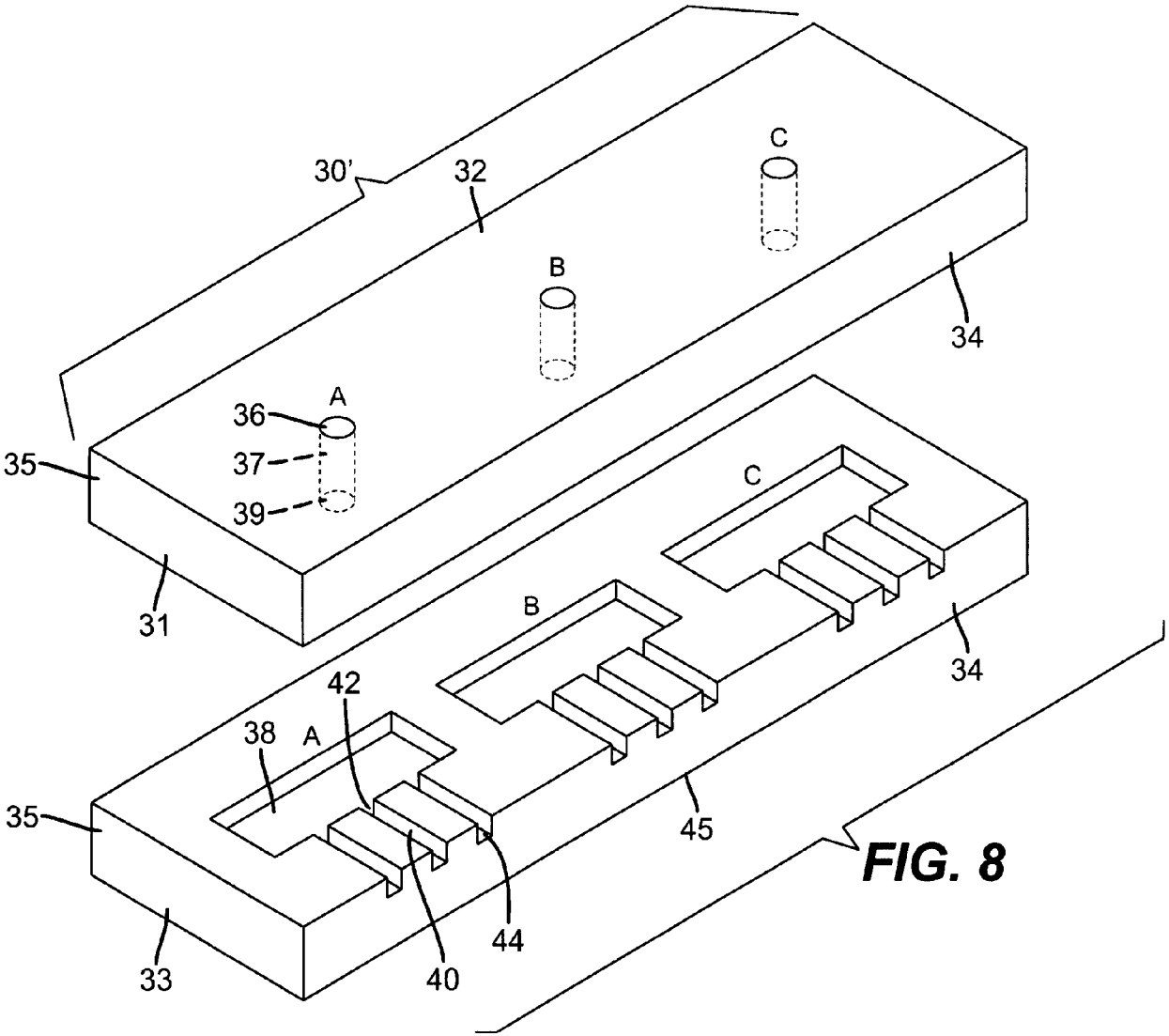
FIG. 8 is an exploded view of an alternate micro-machined manifold used to carry out the present invention.
Figure 13:
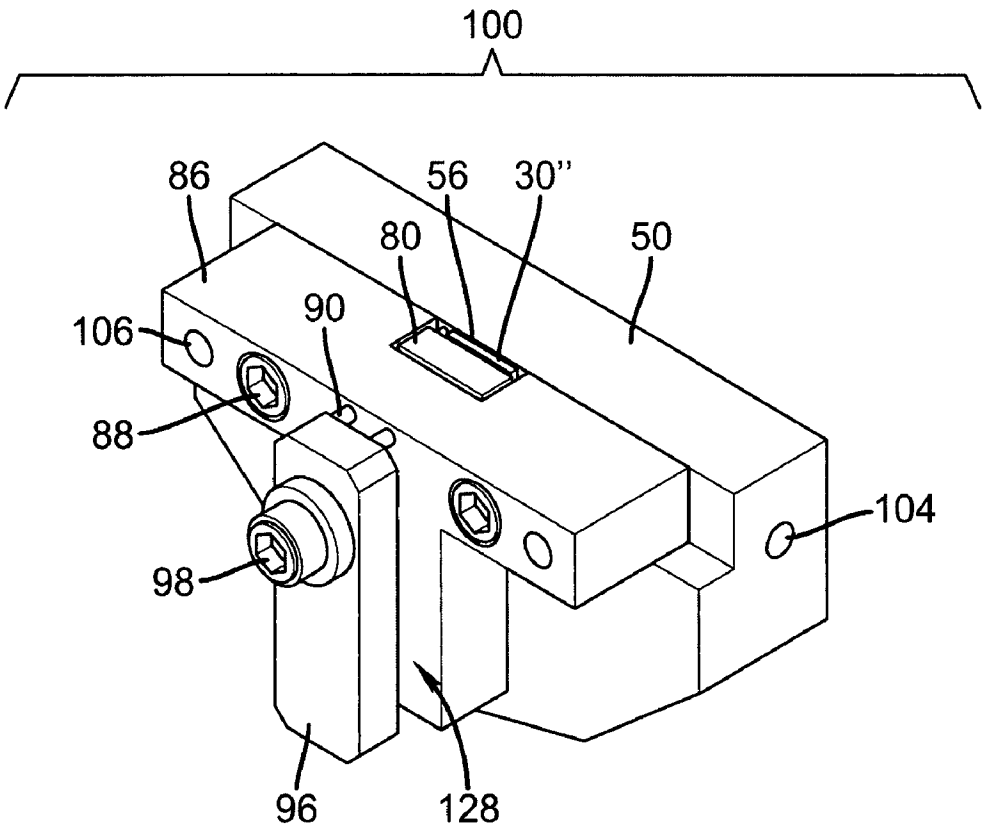
FIG. 13 is a three dimensional view of a printhead incorporating the alternate or second alternate micro-machined manifold.

FIG. 8 shows an exploded view of an alternate micro-machined manifold 30' containing multiple entrance ports 36 and separate fluid chambers 38 labeled A, B and C each containing micro-nozzle arrays 40. This configuration of the micro-machined manifold 30' has the first surface 32 perpendicular to the second surface 34. Here the first piece 31 of the alternate micro-machined manifold 30' is the same as that shown in FIG. 7. In this case the second piece 33 of the alternate micro-machined manifold 30' has micro-nozzles 40 directed through the side of the fluid chambers 38 with their micro-nozzle inlets 42 being built into the sidewalls of the fluid channels and their micro-nozzle outlets 44 being on the side edge of the wafer defining the second surface 34. The micro-nozzles 40 are readily configured as rectangular cross-sections in this alternate micro-machined manifold 30' configuration. As in the discussion of FIG. 7 the first piece 31 and the second piece 33 are first manufactured separately, cleaned, aligned, bonded together at the bond surfaces 35 and diced. When installed in a printhead 100 as shown in FIGS. 11 and 13 the alternate micro-machined manifold 30' is sandwiched between the housing 50 at the manifold mounting surface 51 through a gasket 56 at the first surface 32 and a pressure mounting plate 80 at the pressure plate mounting surface 45 of the second piece 33 which is clamped in place with the housing addendum 59.

Figure 9:
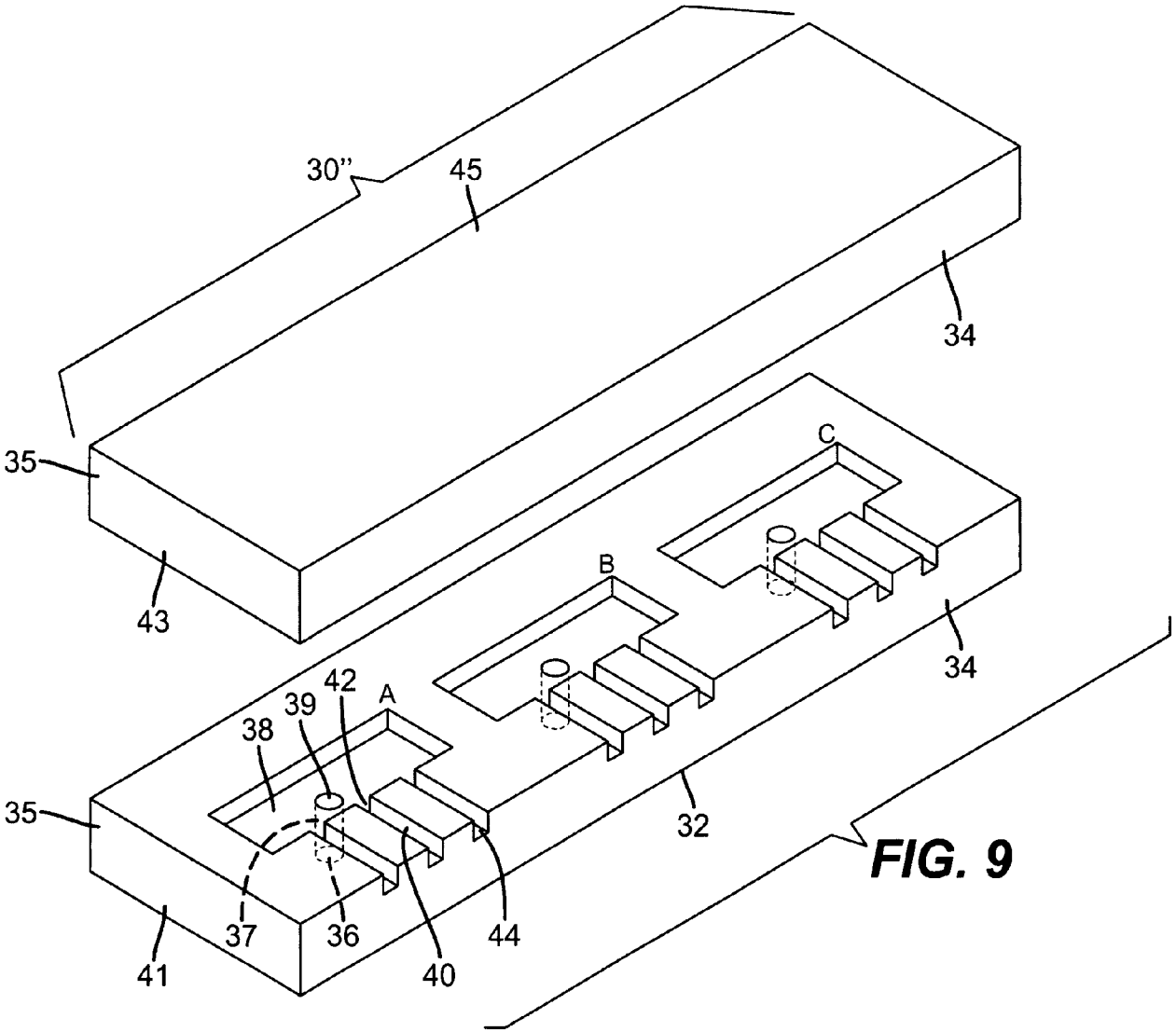
FIG. 9 is an exploded view of a second alternate micro-machined manifold used to carry out the present invention.

FIG. 9 shows an exploded view of a second alternate micro-machined manifold 30" having the first surface 32 perpendicular to the second surface 34. In this case, the entrance ports 36, through holes 37, fluid chamber inlets 39, fluid chambers 38, micro-nozzle inlets 42, micro-nozzles 40 and micro-nozzle outlets 44 are all micro-machined in the alternate first piece 41. Here, the alternate second piece 43 requires no micro machining. After the micromachining of the alternate first piece 41 the two wafers are cleaned, aligned, bonded together at the bond surfaces 35 and diced. When installed in a printhead 100 as shown in FIGS. 11 and 13 the second alternate micro-machined manifold 30" is sandwiched between the housing 50 at the manifold mounting surface 51 through a gasket 56 at the first surface 32 and a pressure plate 80 at the pressure plate mounting surface 45 of the alternate second piece 43 which is clamped in place with the housing addendum 59.

Figure 10:
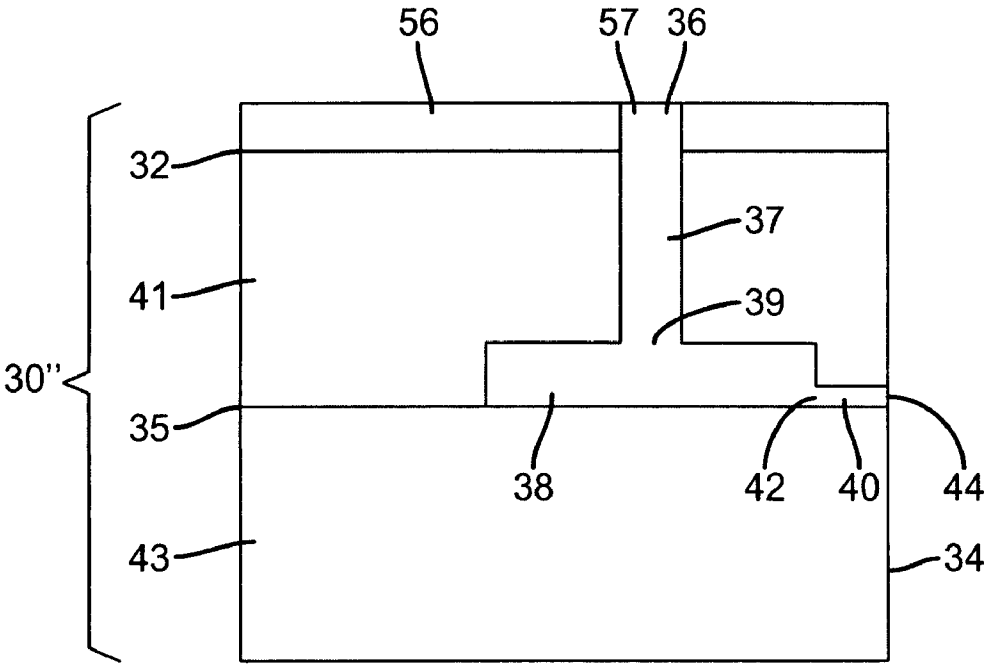
FIG. 10 is side view cross section of the second alternate micro-machined manifold used to carry out the present invention shown in FIG. 7.

FIG. 10 shows a side view cross section of the second alternate micro-machined manifold 30" used to carry out the present invention. FIG. 10 includes a gasket 56 used for high pressure sealing of the second alternate micro-machined manifold 30" to the housing 50. The gasket, 56 interfaces to the first surface 32 of the micro machined manifold 30 and includes one or more gasket holes 57 aligned with inlet ports 36 of the through holes 37 thus enabling the flow path of compressed fluid and marking material into the fluid chamber 38 when interfaced to the housing. In general, the fluid chamber 38, and the micro-nozzles 40 can be machined to different depths as shown in FIG. 10.

Figure 11:
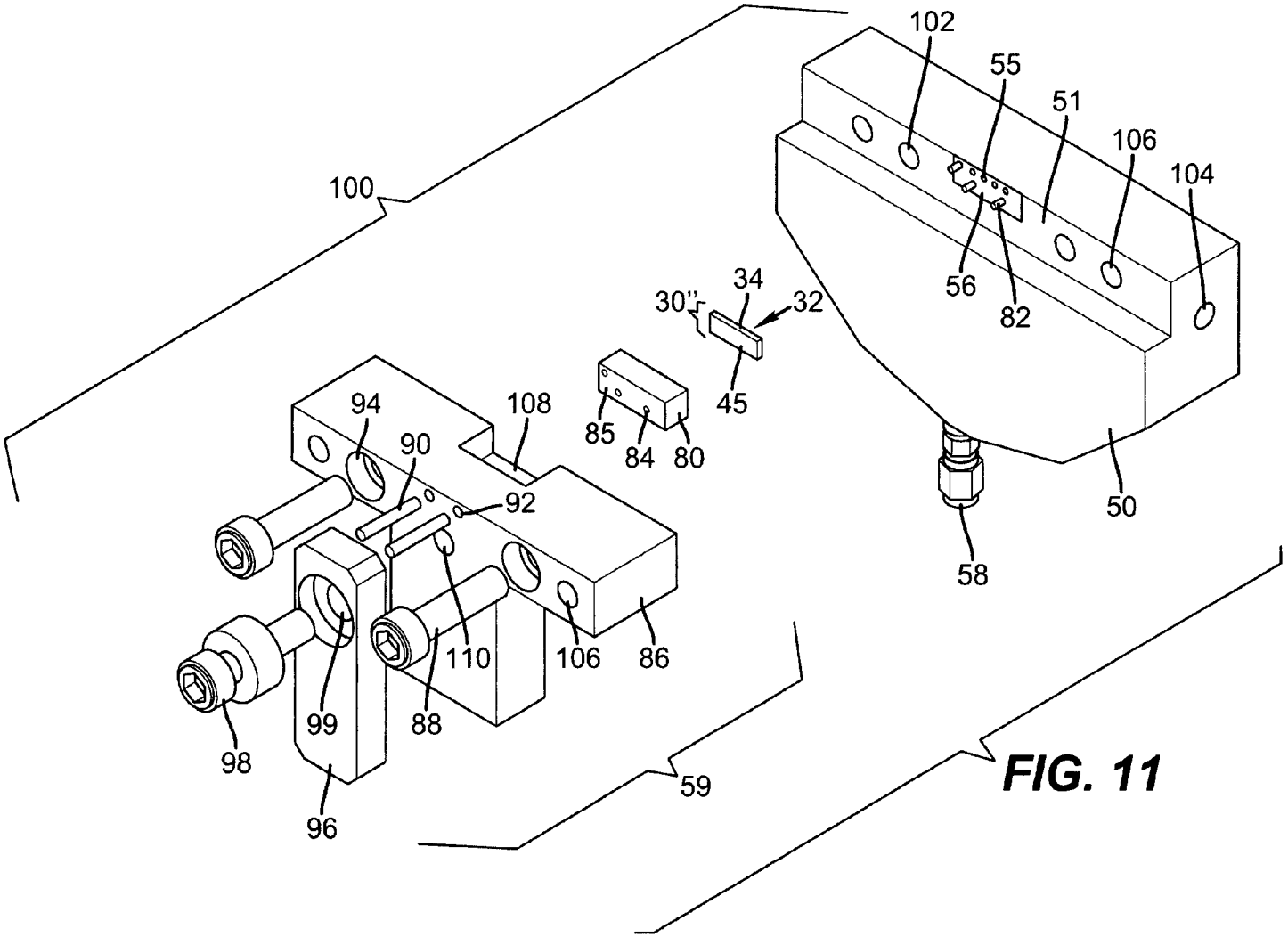
FIG. 11 is an exploded view of a printhead incorporating the alternate or second alternate micro-machined manifold.
Figure 12:
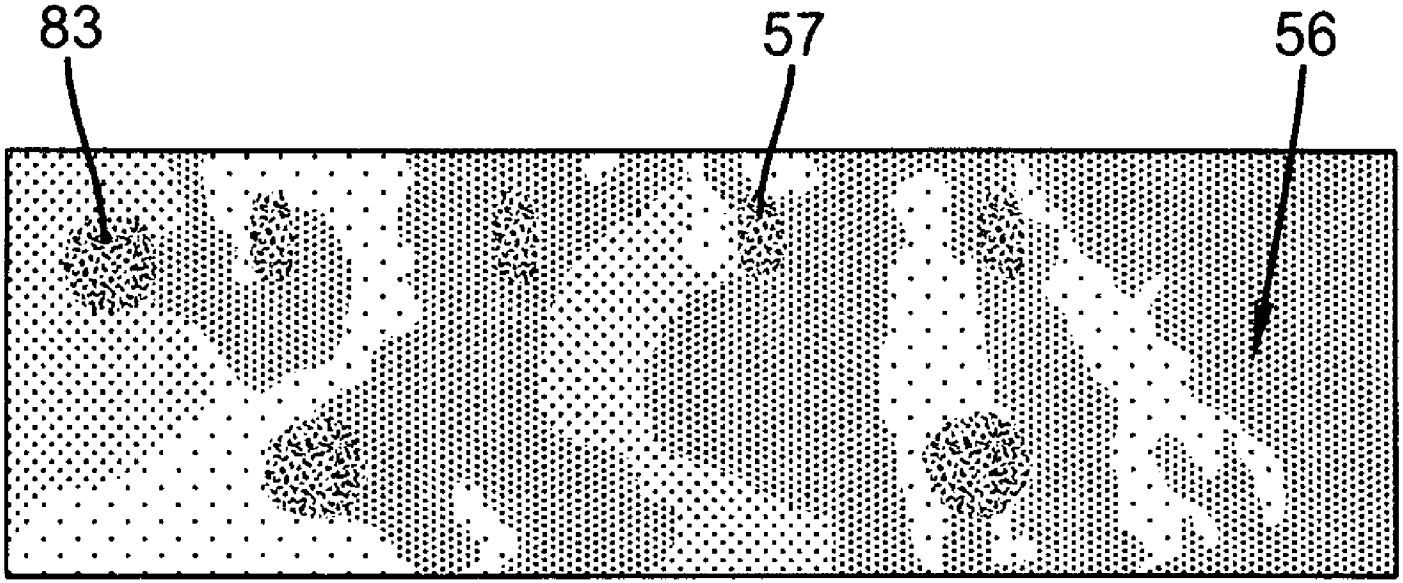
FIG. 12 shows a gasket used in the printhead of FIG. 9.

FIG. 11 shows an exploded view of a printhead 100 incorporating the second alternate micro-machined manifold 30" shown in FIG. 9. The alternate micro-machined manifold 30' shown in FIG. 8 could also be used in the printhead 100 shown in FIG. 11. The micro-machined manifold 30" is mounted in the printhead 100 and held in place under compression with a pressure plate 80 in contact with the pressure plate mounting surface 45 of the micro-machined manifold 30" and with a gasket 56 in contact with the first surface 32 of the micro-machined manifold 30". The gasket 56 is shown in FIG. 12 has gasket alignment holes 83 which fit into the housing alignment pins 82 which align gasket holes 57 with the housing conduit outlets 55 when the gasket is installed and pressed against the housing's manifold mounting surface 51. The gasket 56 shown in FIG. 12 was made from 50 μm thick Indium Alloy #2 from Indium Corporation of America with composition In (80%)-Pb (15%)-Ag (5%) but it can also be made of any soft metal alloy foil or high temperature plastic material such as Teflon or polyimide. The holes in the gasket 56 were made by laser cutting as were the edge cutting to final dimensions. Before installing into printhead 100 the micro-machined manifold 30" is diced to appropriate size so that when it is installed the entrance ports 36 align with the gasket holes 57 (as shown in FIG. 10) and the housing conduit outlets 55. After installing the gasket into the housing 50 the bottom and left edges of the micro-machined manifold 30" as oriented as in FIG. 11 are set to contact the alignment pins 82 with the first surface 32 facing the gasket 56 and the second surface 34 facing up. The alignment pin slots 84 of pressure plate 80 are then inserted into the alignment pins 82 and pressed together. The pressure plate support member is then installed onto the housing 50 so that the pressure plate 80 fits in the pressure plate support cut out 108 with the pressure plate support member bolts 88 being inserted into the pressure plate support member bolt slots 94 of pressure plate support member 86 and being threaded into bolt receptacles 102 on housing 50. In order to apply a uniform pressure to the pressure plate mounting surface 45 of the micro-machined manifold 30", the gasket 56 and the manifold mounting surface 51, pressure distributor pins 90 are inserted into the pressure distributor pin slots 92 in pressure plate support member 86 which contact the pressure distribution surface 85 of pressure plate 80. Pressure is applied to the pressure distributor pins 90 by a tension control bolt 98 which couples to and passes through a pressure distributor 96 at a pressure distributor bolt hole 99 and is threaded into a tension control bolt receptacle 110 on the pressure plate support member 86. An assembled view of the printhead 100 of FIG. 11 is shown in FIG. 13. The lower part of the pressure distributor has a hidden pressure distribution point 128 facing the pressure plate support member 86. This allows the pressure to be distributed uniformly over the manifold 30" in order to create a secure gasket seal that can survive operating conditions in the range of 40-100° C. and 1-350 bar operating pressures. The gasket 56 is an example of a sealing member which ensures a sealed connection. FIG. 11 also includes a conduit connection means 58 which couples the printhead 100 to the conduit 52 shown in FIGS. 1-5. Not shown in FIG. 11 is the housing conduit 53 which provides a continuous fluid path from the conduit connection means 58 to the housing conduit outlet 55 thus permitting fluid communication between the high-pressure source 20 and the entrance port 36 of the micro-machined manifold 30". Also included in the housing 50 and/or housing addendum 59 are a heater slot 104 for embedding heaters to control the temperature of the manifold and thermocouple slots 106 for installing thermocouples or thermistors for monitoring temperature of the printhead.

The micro-nozzles 40 can have a constant cross sectional area or a variable cross sectional area along their length. Various nozzle designs have been disclosed in U.S. Pat. No. 6,752,484 and are incorporated herein by reference. Typical dimensions for features in any of the micro-machined manifold designs 30, 30' or 30" are in the range of 0.1 μm to 2000 μm. The length of the micro-nozzles 40 can be 0.10 to 2000 μm long, depth can be in the range of 0.1 to 500 μm, and width can be in the range of 0.1 to 500 μm. More preferably the length of the micro-nozzles 40 can be 50 to 1000 μm long, depth can be in the range of 5 to 100 μm, and width can be in the range of 5 to 100 μm. Most preferably the length of the micro-nozzles 40 can be 50 to 900 μm long, depth can be in the range of 5 to 50 μm, and width can be in the range of 5 to 50 μm. The fluid chamber 38 can be designed to dampen out any flow disturbances while distributing the flow. However, it may be advantageous to minimize its volume in some instances. Similarly it may also be advantageous to minimize the through holes' 37 volumes.

Figure 14:
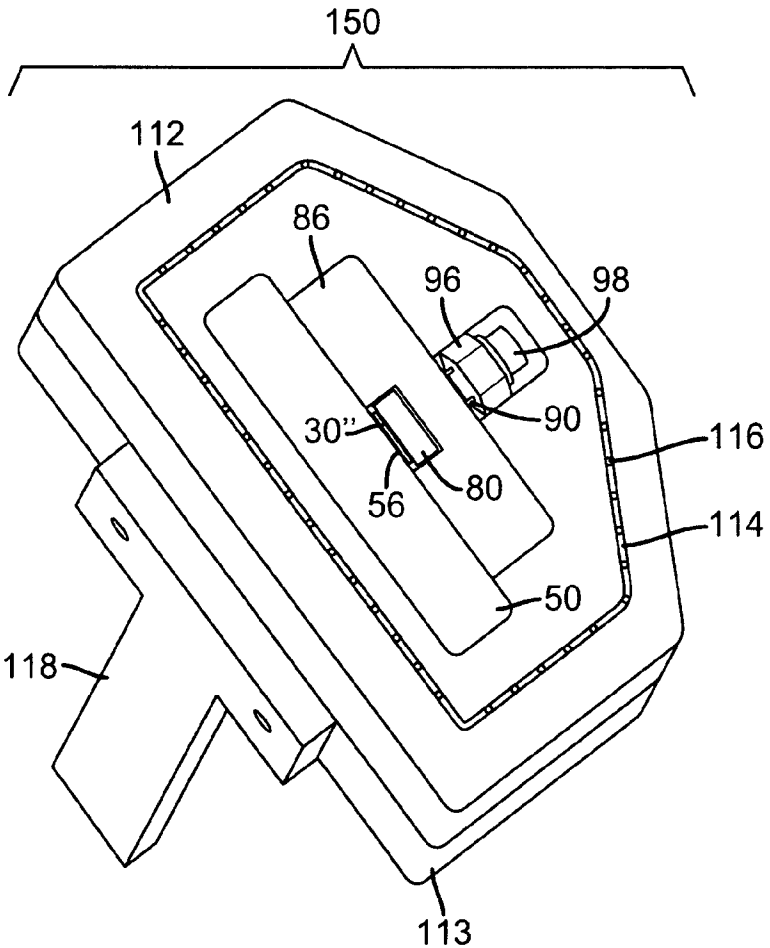
FIG. 14 is a three dimensional view of a printhead incorporating the alternate or second alternate micro-machined manifold and a stray particle collection means.

When printing with compressed fluids such as $CO_2$ the gas undergoes rapid expansion and the marking material is carried along originally at the velocity of the gas. Typically, the marking material exists in the directed beam as nano-scale particles that are less than 1 μm in diameter, and many of them can be nano-particles with diameter less than 0.1 μm. When these nano-scale particles approach a substrate, they may adhere to the surface, get embedded below the surface or bounce off the surface of the substrate. It is advantageous to collect any particles of marking material that bounce off the surface of the substrate. A particle collection means incorporating a suction means has been developed for this purpose. FIG. 14 is a three dimensional view of a printhead with particle collection means 150 incorporating the alternate 30' or second alternate micro-machined manifold 30" and a particle suction means 112. The particle suction means 112 surrounds the printhead with particle collection means 150 and it has a suction channel 114 milled into it with optional multiple suction micro channels 116. The milled opening of the suction channel 114 faces the substrate as does the micro-nozzle outlets 44 of second surface 34. The particle suction means 112 also has a suction means back piece 113 attached to it. The suction means back piece 113 has a connection means for attachment to a suitable vacuum source such as an aspirator or vacuum pump to provide suction capability. The same suction means 112 also captures effluent gases released during the printing process. These effluent gases can then be sent to a recycling system. FIG. 14 also explicitly shows a printhead mounting means 118 for interfacing the printhead to a positioning mechanism. This printhead mounting means can be incorporated into any of the printing apparatus described in this patent document.

Figure 15:
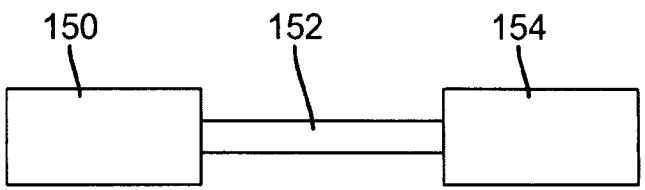
FIG. 15 is a schematic view of a printing apparatus with stray particle collection means.

FIG. 15 shows the arrangement of collection means 154 relative to the printhead with particle collection means 150 connected together with suction conduit 152. The collection means 154 includes the vacuum source and may also include a solvent bath containing water or other suitable liquids useful in collecting the particles and filtration membranes, impactors etc.

Figure 16:
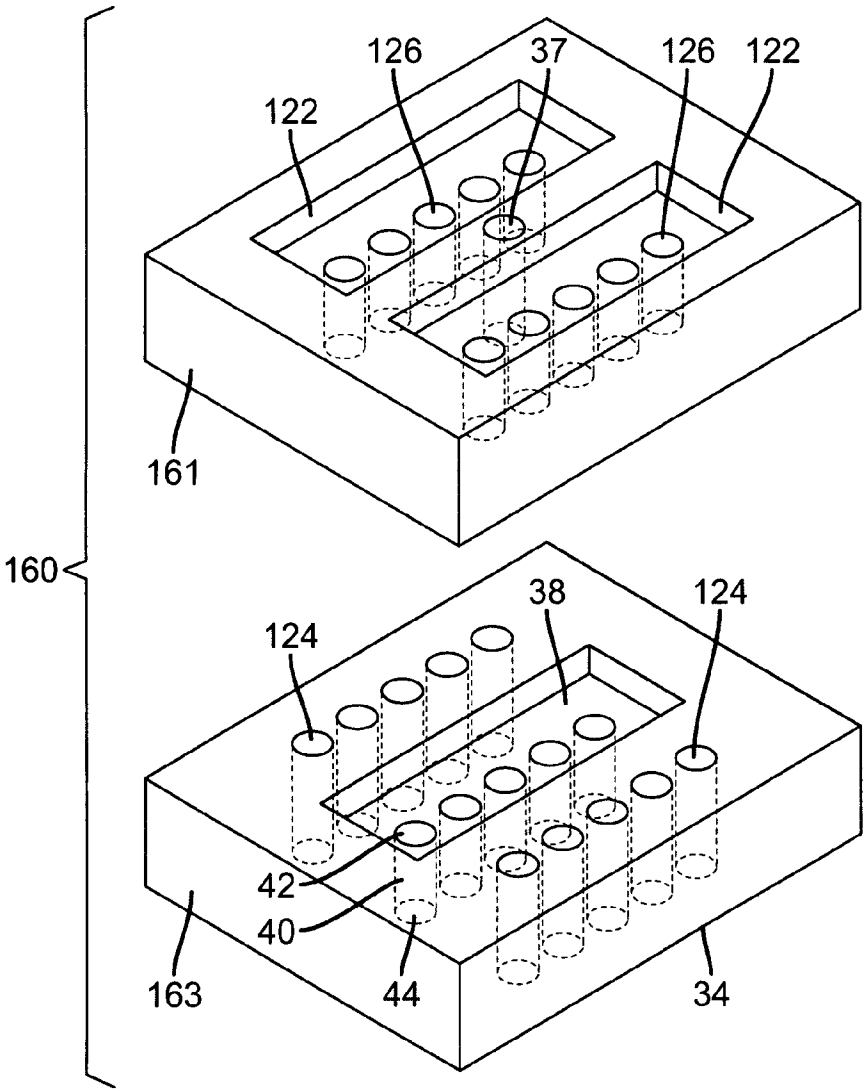
FIG. 16 is an exploded view of a micro-machined manifold with built-in stray particle suction means.

FIG. 16 is an exploded view of a micro-machined manifold with particle suction means 160 integrated into the manifold. The micro-machined manifold 160 has the same basic structure as the micro-machined manifold 30 shown in FIG. 7 with the addition of micro-machined suction channels 122 and suction micro channels 126 on the first piece 161 which mate to suction micro channels 124 on the second piece 163. These two pieces 161 and 163 are bonded together and diced before used. The housing for this manifold includes a suction channel (not shown) that is in fluid communication with the suction conduit 152 shown in FIG. 15. Although only one fluidic channel 38 is shown in FIG. 16 multiple fluidic channels 38 can be constructed like that shown in FIG. 7 with integrated particle suction means integrated into the micro-machined manifold with suction means 160. Each marking material can then have its own integrated particle suction means integrated into the micro-machined manifold with suction means 160. This allows collection and recycling of the materials that are not printed.

The substrate can be positioned on a substrate conveyance mechanism 62 that is used to control the movement of the substrate during the operation of the printing apparatus 100. The substrate conveyance mechanism 62 can be a drum, an x, y, z translator, any other known media conveyance mechanism, etc. The printhead position can also be controlled by an x, y, z conveyance mechanism interfaced to the printhead mounting means 118. The printing apparatus 100 may have the manifold 30 being rigidly connected to the pressurized source such that the micro-machined manifold 30 is stationary and the substrate conveyance mechanism 62 is moveably positioned relative to the micro-machined manifold 30 while maintaining a predetermined distance from the outlets of the micro-nozzles 44 to the substrate. The printing apparatus 100 can also have the substrate conveyance mechanism being moveable in a first direction and the micro-machined manifold 30 being movable in a second direction while maintaining a predetermined distance from the outlets of the micro-nozzles 44 to the substrate. The printing apparatus 100 could also have the micro-machined manifold 30 being flexibly connected to the high-pressure source 20, the manifold being moveable in at least a first direction while the substrate conveyance mechanism 62 is stationary and is used only to retain the substrate 60. In all of these cases the printing apparatus 100 has a conveyance mechanism to control the lateral (x, y) position of the directed beams 64 with respect to the substrate while the substrate 60 is being maintained at a predetermined distance (z) from the outlets of the micro-nozzles 44.

Any of the printing apparatuses 10 disclosed here in could incorporate a cleaning station positioned relative to the printhead, wherein the printhead is moveable to a position over the cleaning station as disclosed in U.S. Pat. No. 6,672,702 by S. Sadasivan et al. The cleaning station may also include a collection means to collect material being cleaned from the printhead 100. Any of the printing apparatuses 10 disclosed here in could also incorporate a calibration station similar to that disclosed in U.S. Pat. No. 6,672,702 by S. Sadasivan et al.

EXAMPLE 1

Figure 17:
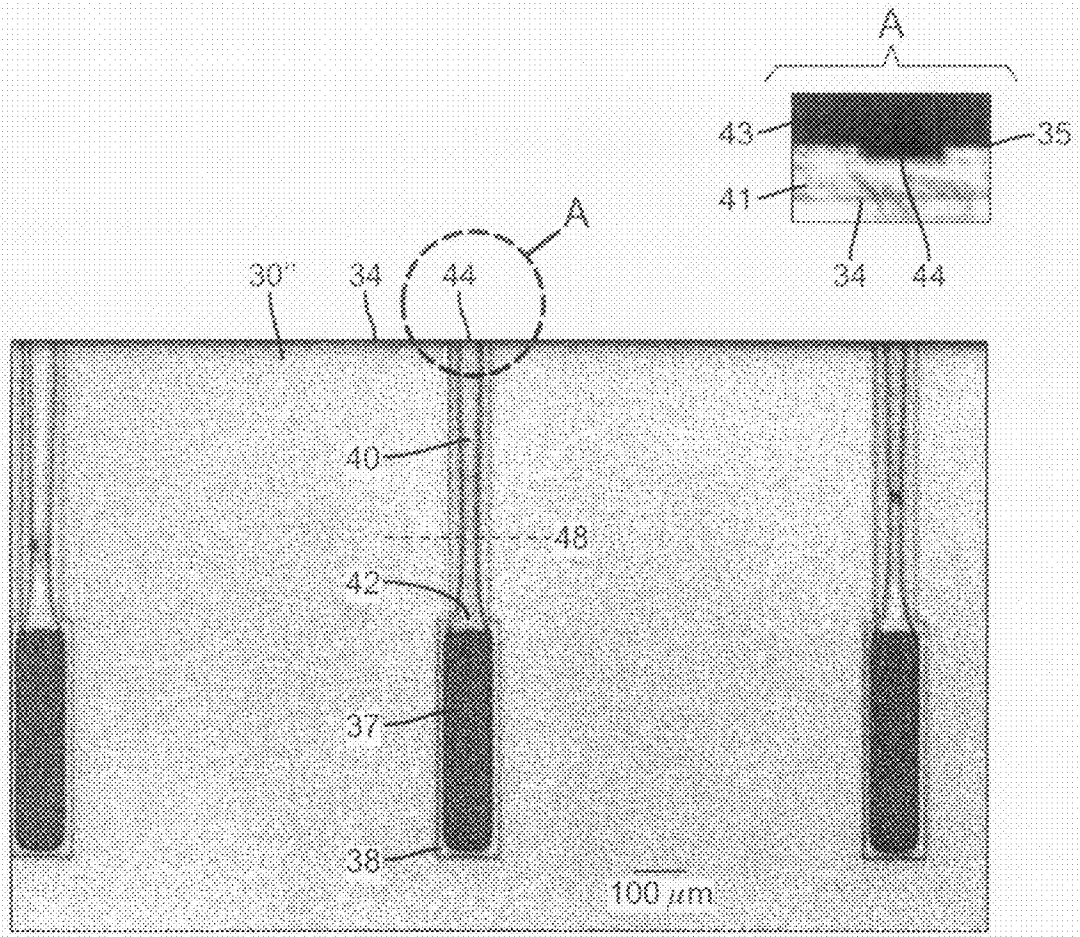
FIG. 17 is an optical micrograph of a portion of a micro-machined manifold used in carrying out the present invention.

A 250 ml high-pressure vessel was used as the source of the marking material. The vessel had a floating piston, resistive heaters and a mechanical stirrer to allow operation at desired pressure and temperature. The vessel was connected to the housing with stainless steel tubing that was kept at constant temperature with a circulating water jacket. The silicon side of a 9.9 mm long, 2.5 mm wide, and 1.135 mm thick micro-machined glass-silicon manifold was interfaced with the housing by interposing an In (80%)-Pb (15%)-Ag (5%) gasket that had laser cut holes to mate with conduits in the housing. FIG. 17 shows an optical micrograph of a portion of the micro-machined manifold 30" used in this example. The micro-machined manifold 30" shown in the photograph of FIG. 17 is similar to the one shown in FIG. 9 with the exception that there is only one micro-nozzle 40 per fluid chamber 38. The photograph of FIG. 17 was taken with the glass or alternate second piece 43 facing up. All of the micro machining was performed in the bottom silicon layer or alternate first piece 41. The center micro-nozzle 40 was used in this example to demonstrate printing capability. The entrance ports 36 and through holes 37 of the micro-machined manifold 30" were 500 μm long, 100 μm wide, and 410 μm deep. Each of them opened into a fluid chamber 38 that was also nominally 500 μm long, 100 μm wide, and 15 μm deep. The fluid chamber 38 opened into a 100 μm wide micro-nozzle inlet 42 that was 15 μm deep. The micro-nozzle 40 ran parallel to the major faces of the micro-machined manifold 30", essentially providing a side-shooter configuration. Along the micro-nozzles 40 which were 620 μm long, they had a rectangular cross-section with a convergent-divergent profile with a depth of 15 μm. The widths at the throat plane indicated by the dotted line 48 were about 37 μm which diverged back to about 100 μm at the micro-nozzle outlet 44. The oval surrounding micro-nozzle outlet 44 in FIG. 17 labeled A points to a cross-section showing a surface view of the second surface 34 surrounding the micro-nozzle outlet 44. While the entrance port 36, fluid chamber 38, and micro-nozzles 40 were micro-machined from a single silicon wafer, they were glue bonded to a 710 μm thick layer of glass at bonding surface 35. The micro-machined manifold 30" and gasket 56 shown in FIG. 12 were clamped together to provide a leak-proof connection between the housing 50 and the micro-machined manifold 30" using the apparatus shown in FIGS. 11 and 13. The housing 50 was held stationary and oriented such that the exits of the micro-nozzles 44 in the micro-machined manifold 30" were spaced at a desired distance parallel to the substrate. The substrate 60 was mounted on a movable transport stage, and held in place with vacuum suction on its backside that served as the substrate conveyance mechanism 62.

A homogeneous compressed fluid solution of 240 mg of Dye-1 (a peracetylated glycoconjugated colorant) and 200 g CO2 was prepared in the high-pressure vessel at 40 degrees Centigrade and 100 bar which served as the high-pressure source 20 of compressed fluid and marking material. The molecular structure of Dye-1 was as follows:

Dye-1

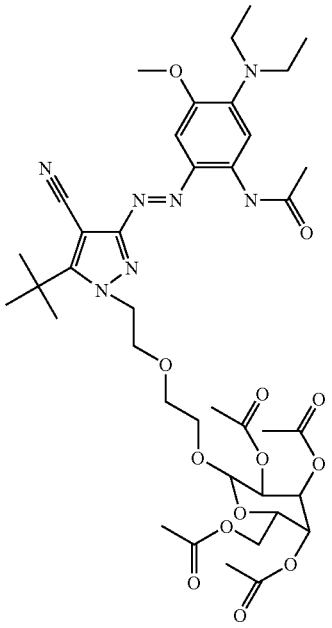

A Kodak Photo Quality Ink Jet Paper was used as the substrate 60. The design of Kodak Photo Quality IJ Paper is described in U.S. Pat. No. 6,040,060, which is incorporated herein by reference. Kodak Photo Quality Ink Jet Paper comprises raw paper base that is then resin coated on both sides. Subsequently this paper is coated on one side with two ink-receiving layers. The base layer comprises gelatin and a material selected from the group consisting of carboxymethyl cellulose, polyvinylpyrrolidone, polyvinylalcohol, hydroxyethyl cellulose and mixtures thereof. The top layer comprises a material selected from the group consisting of an acrylic acid-diallyldimethylammonium chloride-hydroxypropyl acrylic copolymer and acrylic acid-diallyldimethylammonium chloride polymer. The top layer is approximately 1-3 μm thick while the base layer that contacts the resin-coated paper is approximately 10-15 micrometers thick.

Figure 18:
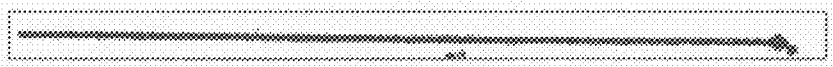
FIG. 18 is a photograph of the line described in Example 1.

When the on/off valve 22 between the high-pressure chamber 20 and housing 50 was opened, the compressed fluid mixture flowed through the housing 50 and the micro-machined manifold 30" before exiting as a directed beam 64 that was directed onto the substrate 60. The substrate was spaced 2 mm away from the micro-nozzle outlets 44 and second surface 34 and was moved laterally at a speed of ca. 2.3 m/min. The resultant line was about 250 μm wide as shown in the photograph shown in FIG. 18. The divergence angle of the directed beam 64 of compressed fluid and marking material was about 2.15 degrees in this example.

EXAMPLE 2

Figure 19:
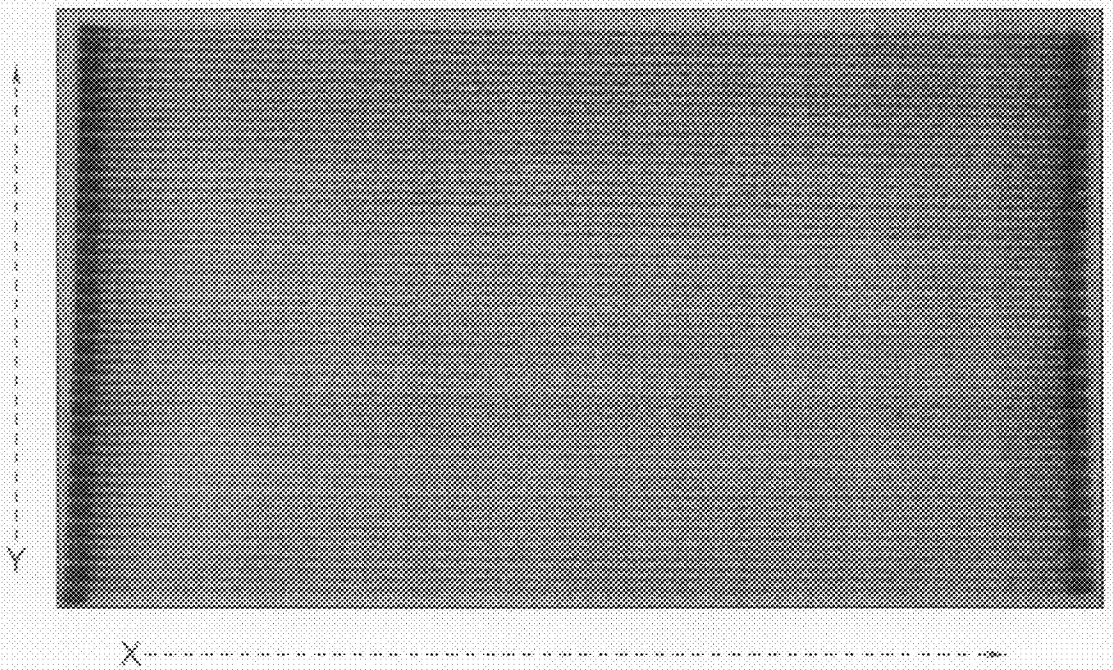
FIG. 19 is photograph of a printed pattern of lines described in Example 2.

The housing 50 in Example 1 was attached to a different positional control unit that allowed the substrate to move along the x-axis and the housing was now movable—along the y-axis displacing orthogonally back and forth for each new line. Example 1 was then repeated with the following exceptions: (1) Compressed fluid mixture was kept at 125 bar; (2) the substrate 60 was spaced 0.76 mm away from the micro-nozzle outlets 44 at the second surface 43; and (3) the housing 50 and substrate 60 were moved laterally back and forth at a nominal speed of ca. 5.31 m/min. The average line width was ca. 184 μm. (See FIG. 19) which is equivalent to a divergence angle of 3.2 degrees.

EXAMPLE 3

Example 2 was repeated with the following exceptions: (1) Compressed fluid mixture was kept at 200 bar; and (2) the housing 50 and substrate 60 was moved laterally back and forth at a nominal speed of ca. 15.93 m/min. The average line width was ca. 104 μm which is equivalent to a divergence angle of 0.15 degrees.

EXAMPLE 4

Figure 20:
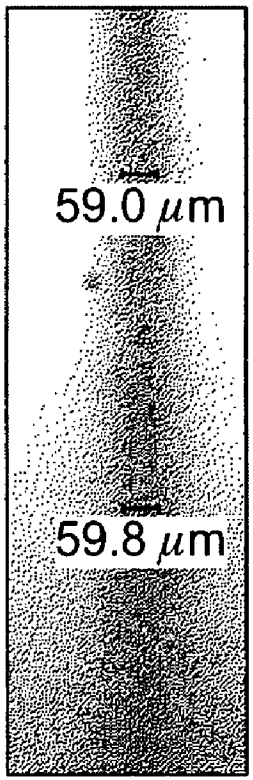
FIG. 20 is an optical micrograph of a line described in Example 4.

The micro-machined manifold 30" of Example 2 was replaced with a new micro-machined manifold 30" made from two silicon wafers that were fusion bonded together. The entrance port of the manifold had a 200 μm diameter circular cross section. It opened into a fluid chamber that was ca. 350 μm wide, 350 μm long and 50 μm deep. This was connected to a micro-nozzle that was rectangular in cross section, 10 μm wide, 50 μm deep and 225 μm long. An experiment was conducted similar to Example 2 with the following operating conditions: (1) Compressed fluid mixture was kept at 100 bar and 40 C; (2) The substrate was placed 0.76 mm away from the micro-nozzle exit; and (2) the housing was moved laterally back and forth at a nominal speed of ca. 5.31 m/min. The average line width was ca. 60 μm (See FIG. 20) which is equivalent to a divergence angle of 0.37 degrees.

EXAMPLE 5

A procedure similar to Example 2 was followed but a few changes were made in equipment, materials, and operating conditions as noted below. (1) The micro-machined manifold of Example 2 was replaced with a new manifold made from two silicon wafers that were fusion bonded together. The entrance port of the manifold had a 200 μm diameter circular cross section. It opened into a fluid chamber that was ca. 350 μm wide, 350 μm long and 50 μm deep. At the junction of this chamber to a micro-nozzle, a small structure required flow to pass around it before entering the micro-nozzle. The latter was rectangular in cross section, 20 μm wide, 50 μm deep and 900 μm long. (2) A homogeneous compressed fluid solution of 404 mg of Dye-2 (a peracetylated glycoconjugated colorant), 0.64 g of acetone, and 200 g CO2 was prepared in the high-pressure vessel at 40 C and 100 bar. The molecular structure of Dye-2 was as follows:

Dye-2

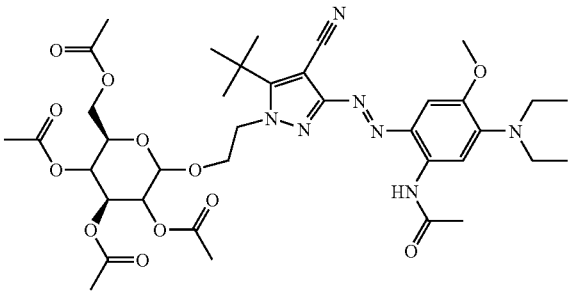

(3) The plain paper was used as the substrate and it was placed 1.168 mm away from the micro-nozzle exit; and (4) the housing was moved laterally back and forth at a nominal speed of ca. 26.56 m/min. The average line width was ca. 128 μm which is equivalent to a divergence angle of 1.92 degrees.

The invention has been described in detail with particular reference to certain preferred embodiments thereof, but it will be understood that variations and modifications can be effected within the scope of the invention.

PARTS LIST

| | |
|---|---|
| 10 | Printing apparatus |
| 20 | High-pressure source |
| 21 | Compressed fluid control valve |
| 22 | On/off valve |
| 23 | Marking material control valve |
| 24 | Source of compressed fluid |
| 25 | Compressed fluid conduit |
| 26 | Source of marking material |
| 27 | Marking material conduit |
| 28 | Removable canister |
| 30 | Micro-machined manifold |
| 30' | Alternate micro-machined manifold |
| 30" | Second alternate micro-machined manifold |
| 31 | First piece |
| 32 | First surface |
| 33 | Second piece |
| 34 | Second surface |

-continued

| | |
|---|---|
| 35 | Bond surface |
| 36 | Entrance port |
| 37 | Through hole |
| 38 | Fluid chamber |
| 39 | Fluid chamber inlet |
| 40 | Micro-nozzle |
| 41 | Alternate first piece |
| 42 | Micro-nozzle inlet |
| 43 | Alternate second piece |
| 44 | Micro-nozzle outlet |
| 45 | Pressure plate mounting surface |
| 46 | Control valve |
| 48 | Micro-nozzle throat plane |
| 50 | Housing |
| 51 | Manifold mounting surface |
| 52 | Conduit |
| 53 | Housing conduit |
| 54 | Sealing member |
| 55 | Housing conduit outlet |
| 56 | Gasket |
| 57 | Gasket hole |
| 58 | Conduit connection means |
| 59 | Housing addendum |
| 60 | Substrate |
| 61 | Facing surface of substrate |
| 62 | Substrate conveyance mechanism |
| 64 | Directed beams |
| 66 | Shutter |
| 80 | Pressure plate |
| 82 | Alignment pins |
| 83 | Gasket alignment holes |
| 84 | Alignment pin slots |
| 85 | Pressure distribution surface |
| 86 | Pressure plate support member |
| 88 | Pressure plate support member bolts |
| 90 | Pressure distributor pins |
| 92 | Pressure distributor pin slots |
| 94 | Pressure plate support member bolt slots |
| 96 | Pressure distributor |
| 98 | Tension control bolt |
| 99 | Pressure distributor bolt hole |
| 100 | Printhead |
| 102 | Bolt receptacle. |
| 104 | Heater slot |
| 106 | Thermocouple slot |
| 108 | Pressure plate support cut out |
| 110 | Tension control bolt receptacle |
| 112 | Suction means |
| 113 | Suction means back piece |
| 114 | Suction channel |
| 116 | Suction micro-channels |
| 118 | Mounting means |
| 120 | Operator |
| 122 | Micro-machined suction channel |
| 124 | Suction micro-channels second piece |
| 126 | Suction micro channels first piece |
| 128 | Hidden pressure distribution point |
| 150 | Printhead with particle collection means |
| 152 | Suction conduit |
| 154 | Collection means |
| 160 | Micro-machined manifold with suction means |
| 161 | First piece |
| 163 | Second piece |

The invention claimed is:

1. A printing apparatus for delivering a mixture of compressed fluid and marking material and depositing the marking material in a pattern onto a substrate, comprising:

a high pressure source of a mixture of compressed fluid and marking material;

a micro-machined manifold including a plurality of micro-nozzles, a fluid chamber, an entrance port, the micro-machined manifold including a first surface and a second surface, portions of the first surface defining the entrance port, the entrance port being connected in fluid communication with the fluid chamber, each of the micro-nozzles having an inlet and an outlet, the inlet being connected in fluid communication with the fluid chamber, the outlet being located on the second surface, each micro-nozzle being shaped to produce a directed beam of the mixture of compressed fluid and marking material beyond the outlet of the micro-nozzle; and a housing connected in fluid communication with the high pressure source and the entrance port of the micro-machined manifold, the connection between the housing and the micro-machined manifold being a sealed connection.

2. The printing apparatus of claim 1, each of the plurality of micro-nozzles including a control valve, wherein each control valve has a first position that provides a continuous flow of the mixture of compressed fluid and marking material through the micro-nozzle and a second position that restricts flow of the mixture of the compressed fluid and marking material through the micro-nozzle.

3. The printing apparatus according to claim 1, further comprising:

a substrate conveyance mechanism, wherein one at least one of the conveyance mechanism and the housing control a relative position of the substrate and the micro-machined manifold during operation.

4. The printing apparatus according to claim 1, further comprising:

a particle collection means to capture marking material that does not adhere to the substrate.

5. The printing apparatus according to claim 4, the particle collection means comprising a channel located on the housing and facing the substrate, the channel being connected to a vacuum source.

6. The printing apparatus according to claim 4 wherein a portion of the particle collection means is integrated into the micro-machined manifold.

7. The printing apparatus according to claim 1 wherein the high pressure source comprises a removable canister loaded with a thermodynamically stable mixture of the marking material and the compressed fluid, the canister being removably connected to the housing via a conduit connection means.

8. The printing apparatus according to claim 7, wherein the printing apparatus is portable by a user.

9. The printing apparatus according to claim 1, wherein the high pressure source includes a mixture of a compressed carbon dioxide and a peracetylated glycoconjugated marking material.

10. The printing apparatus according to claim 1, further comprising:

a source of the marking material connected to the high pressure source.

11. The printing apparatus according to claim 1, further comprising:

a source of the compressed fluid connected to the high pressure source.

12. The printing apparatus according to claim 1, the high pressure source being a first high pressure source, the entrance port of the micro-machined manifold being a first entrance port, the fluid chamber of the micro-machined manifold being a first fluid chamber, the plurality of micro-nozzles of the micro-machined manifold being a first plurality of nozzles, the apparatus further comprising:

a second high pressure source of a mixture of compressed fluid and marking material, the micro-machined manifold including a second entrance port, the second entrance port being in fluid communication with the second high pressure source through the housing, the second entrance port being connected in fluid communication with a second fluid chamber connected in fluid communication with a second plurality of micro-nozzles.

13. The printing apparatus of claim 12, wherein the portion of the micro-machined manifold that includes the second entrance port, the second fluid chamber, and the second plurality of micro-nozzles is physically separated from the portion of the micro-machined manifold that includes the first entrance port, the first fluid chamber, and the first plurality of micro-nozzles.

14. The printing apparatus according to claim 1, wherein the first and second surfaces of the micro-machined manifold are perpendicular to each other.

15. The printing apparatus according to claim 1, wherein the micro-nozzles have at least two dimensions between 1 μm and 200 μm.

16. The printing apparatus according to claim 1, wherein the high pressure source further comprises a solvent.

17. A method of printing comprising:

providing a high pressure source of a mixture of compressed fluid and marking material;

providing a micro-machined manifold including a first surface and a second surface, portions of the first surface defining an entrance port, the entrance port being connected in fluid communication with a fluid chamber, a plurality of micro-nozzles each having an inlet and an outlet, the inlet being connected in fluid communication with the fluid chamber, the outlet being located on the second surface, each micro-nozzle being shaped to produce a directed beam of the mixture of compressed fluid and marking material beyond the outlet of the micro-nozzle;

providing a housing connected in fluid communication with the high pressure source and the entrance port of the micro-machined manifold; and controlling the pressure of the mixture of compressed fluid and marking material to create a directed beam of the mixture of compressed fluid and marking material beyond each outlet of each micro-nozzle.

18. The method according to claim 17, wherein the high pressure source includes a mixture of a compressed carbon dioxide and a marking material having a $CO_2$-phobic group and a non-fluorous $CO_2$-philic group.

19. The method according to claim 17, wherein the high pressure source includes a mixture of a compressed carbon dioxide and a peracetylated glycoconjugated marking material.

20. The method according to claim 17, wherein the high pressure source further comprises a solvent.

21. The method according to claim 20, wherein the ratio of solvent and marking material is between 0.01:1 and 100:1.

22. The method according to claim 17, wherein the ratio of compressed fluid and marking material is between $1\times10^5$:1 and 4:1.

23. The method according to claim 17, each of the plurality of micro-nozzles including a control valve, the method further comprising:

using each control valve to control flow of the mixture of compressed fluid and marking material through the micro-nozzle.

24. The method according to claim 17, further comprising:

capturing marking material that does not adhere to the substrate.

25. The method according to claim 17, wherein the high pressure source being a first high pressure source, the entrance port of the micro-machined manifold being a first entrance port, the fluid chamber of the micro-machined manifold being a first fluid chamber, the plurality of micro-nozzles of the micro-machined manifold being a first plurality of nozzles, the method further comprising:

providing a second high pressure source of a mixture of compressed fluid and marking material, the micro-machined manifold including a second entrance port, the second entrance port being in fluid communication with the second high pressure source through the housing, the second entrance port being connected in fluid communication with a second fluid chamber connected in fluid communication with a second plurality of micro-nozzles; and controlling the pressure of the second high pressure source of a mixture of compressed fluid and marking material to create a directed beam of the mixture of second compressed fluid and marking material beyond each outlet of each of the second plurality of micro-nozzles.

* * * * *